US005776263A

United States Patent [19]

Kojima et al.

[11] Patent Number: 5,776,263

[45] Date of Patent: Jul. 7, 1998

[54] METHOD FOR PRODUCING ALLOY POWDER OF THE R2T17 SYSTEM, A METHOD FOR PRODUCING MAGNETIC POWDER OF THE OF THE R2T17NX SYSTEM, AND A HIGH PRESSURE HEAT-TREATMENT APPARATUS

[75] Inventors: Kiyoshi Kojima, Nara; Takeshi Takahashi, Osaka, both of Japan

[73] Assignee: Matsushita Electric Industrial Co., Ltd., Osaka, Japan

[21] Appl. No.: 751,809

[22] Filed: Nov. 19, 1996

Related U.S. Application Data

[63] Continuation of Ser. No. 360,078, Dec. 20, 1994, Pat. No. 5,609,695.

[30] Foreign Application Priority Data

| | | | |
|---|---|---|---|
| Dec. 21, 1993 | [JP] | Japan | 5-322356 |
| Dec. 22, 1993 | [JP] | Japan | 5-324321 |
| Apr. 26, 1994 | [JP] | Japan | 6-088592 |

[51] Int. Cl.[6] ..... H01F 1/053

[52] U.S. Cl. ..... 148/122; 148/101; 148/105

[58] Field of Search ..... 148/101, 102, 148/103, 104, 105, 122; 75/343

[56] References Cited

U.S. PATENT DOCUMENTS

| | | | |
|---|---|---|---|
| 4,131,495 | 12/1978 | Menth et al. | 148/101 |
| 5,288,339 | 2/1994 | Schnitzke et al. | 148/101 |
| 5,760,966 | 8/1988 | Finnegan et al. | 241/1 |

FOREIGN PATENT DOCUMENTS

| | | |
|---|---|---|
| A369097 | 5/1990 | European Pat. Off. . |
| 2-257603 | 2/1990 | Japan . |
| 2-57663 | 2/1990 | Japan . |
| 4-280605 | 10/1992 | Japan . |
| 5-171204 | 9/1993 | Japan . |
| 5-258927 | 10/1993 | Japan . |
| 1554384 | 10/1979 | United Kingdom . |

OTHER PUBLICATIONS

Sugimota, H. et al., "Hydrogen Decrepitation Phenomena in $Sm_2F17$ Alloys", *Proc. of the Sixth International Conference on Ferrites*, (ICF6), Tokyo and Kyoto, Japan 1992, pp. 1145–1148.

Tatami, K, et al., "Magnetic Properties of $Sm_2F_{17}N_{3+\delta}$ Under $N_2$–Gas Up to 10MP", Proc. of 1992, The 16th Japan Applied Magnetic Society Scientific Lecture Summaries, pp. 440.

Ishizaka, C. et al., "Magnetic Properties of the Nitrogenated $Sm_2F_{17}$ Powder", Proc. of The Sixth International Conference on Ferries (ICF 6), Tokyo and Kyoto, Japan 1992, pp. 1092–1095.

*Primary Examiner*—John Sheehan
*Attorney, Agent, or Firm*—McDermott, Will & Emery

[57] ABSTRACT

Homogenizing heat-treatment is conducted for changing an ingot containing R (R: Sm or a substance obtained by replacing a part of Sm with one or more kinds of rare earth elements) and T (T: Fe or a substance obtained by replacing a part of Fe with one or more kinds of transition elements) as main component into an alloy ingot mainly containing a $R_2T_{17}$ phase. Next, the above-described alloy ingot is allowed to absorb hydrogen in hydrogen gas in the temperature range of 70° C. to 300° C. and at pressures of 5kgf/cm$^2$ or more, thus conducting coarse crushing treatment.

5 Claims, 6 Drawing Sheets

METHOD FOR PRODUCING ALLOY POWDER OF THE R2T17 SYSTEM, A METHOD FOR PRODUCING MAGNETIC POWDER OF THE OF THE R2T17NX SYSTEM, AND A HIGH PRESSURE HEAT-TREATMENT APPARATUS

This is a divisional of application Ser No. 08/360,078, filed Dec. 20, 1994 now U.S. Pat. No. 5,609,695.

BACKGROUND OF THE INVENTION

The present invention relates to magnetic powder which is the main component of a bonded magnet used in a motor and the like in large quantities, a method for producing mother alloy powder thereof, and a high pressure heat-treatment apparatus for use in these methods.

A high efficient bonded magnet using high efficient magnetic powder containing rare earth elements as a main component such as anisotropic magnetic powder of the Sm-Co system and isotropic magnetic powder of the Nd-Fe-B system is utilized in devices applying a magnet such as a motor. Such a bonded magnet has come to find wider application gradually. With this trend, there has been required magnets having various characteristics.

Under such circumstances, new magnetic powders have been intensively developed. Among them, magnetic materials of the rare earth(R)-iron(Fe)-nitrogen(N) system, especially magnetic materials of samarium (Sm)-iron-nitrogen system (hereinafter, referred to as Sm-Fe-N system) have attracted attention. However, the development of the magnetic materials of the Sm-Fe-N system is still in the laboratory stage, and hence there has been demand for practical utilization thereof as soon as possible.

The magnetic materials of the Sm-Fe-N system can be obtained by nitrogenating $Sm_2Fe_{17}$ with a structure of $Th_2Zn_{17}$, in which nitrogen atoms enter the specified interstitial sites of the crystal lattice to expand the crystal lattice, resulting in the same crystal structure of the $Th_2Zn_{17}$. The magnetic materials of the Sm-Fe-N system exhibit the most excellent magnetic characteristics when the value of X is in the neighborhood of 3 in a composition formula of $Sm_2Fe_{17}N_x$. The following basic physical properties have been revealed: saturation magnetization: 4 $\pi I_s$=15.7 kG, anisotropic magnetic field: Ha=260 kOe, and Curie point: Tc=470° C.

The processes of producing the magnetic materials of the Sm-Fe-N system can be roughly classified into the following 5 processes (See, ex., Japanese Laid-Open Patent Publication No.2-57663):

(1) Melting and casting process: a process for producing a Sm-Fe mother alloy ingot;

(2) Homogenizing heat-treatment process: a process for making the Sm-Fe mother alloy ingot into the alloy ingot with a main phase of $Sm_2Fe_{17}$;

(3) Coarse crushing process: a process for crushing the alloy ingot with a main phase of $Sm_2Fe_{17}$ into particles with a size of 150 μm or less which is easily nitrogenated;

(4) Nitrogenating process: a process for making $Sm_2Fe_{17}$ into $Sm_2Fe_{17}N_x$; and (5) Fine crushing process: a process for making the $Sm_2Fe_{17}N_x$ particles into magnetically single domain particles (particle size: 1 to 3 μm) in order to enhance the coercive force thereof.

In addition to the above-described processes, annealing treatment is conducted when required after the process(3) or (5) so that distortion, lattice defect or the like resulting from the size reduction step is eliminated, and after the process(4) so that ununiform nitrogenated layer is made uniform, respectively.

Below, each of the above-described processes will now be described in more detail.

In the coarse crushing process (3), crushing has been performed mechanically in conventional methods. For example, various crushers such as jaw crusher have been employed. Also, it has been reported that there is a possibility of coarse crushing by hydrogen decrepitation employed in the production process of sintered magnet of the Nd-Fe-B system.

This hydrogen decrepitation is a conventional method in which the absorption and desorption of hydrogen are repeatedly performed. That is, hydrogen gas is absorbed into alloy at a temperature in the range of 200° to 400° C., after which the absorbed hydrogen is desorbed in an inert gas such as argon at a temperature in the range of 600° to 800° C. It has been reported that an increase in the number of this repetition enables the coarse crushing down to 4 μm (See, Japanese Laid-Open Patent Publication No.2-57663 and EP0369097A1).

Besides, hydrogen decrepitation of $Sm_2Fe_{17}$ has been studied and reported in Tohoku University in recent years (S.Sugimoto et al.: Ferrite Proceedings of the ICF6, Tokyo and Kyoto, Japan,1992, pp.1145 to 1148). According to this paper, $Sm_2Fe_{17}$ subjected to homogenizing heat-treatment will not undergo hydrogen decrepitation in the temperature range of room temperature to 200° C., while it will undergo hydrogen decrepitation at temperatures in the neighborhood of 300° C., resulting in not fine powder, but coarse powder (with a mean particle size of 2 to 3 mm).

However, in the composition wherein the proportion of Sm is increased (by 20% or more), in addition to $Sm_2Fe_{17}$, $SmFe_3$ appears after homogenizing heat-treatment. This $SmFe_3$ causes sharp hydrogen absorption at 200° C., and also the volume expansion of the crystal lattice of $SmFe_3$ is larger than that of $Sm_2Fe_{17}$. Therefore, the alloy ingot is broken into fine powder (with a particle size of 100 μm or less).

Also, the result of the measurement of hydrogen absorption and desorption characteristics showed that $Sm_2Fe_{17}$ exhibited a peak of hydrogen absorption at temperatures in the neighborhood of 250° C. and 600° C., between which, i.e., in the temperature range of 350° C. to 550° C., it exhibited a gentle peak of hydrogen desorption.

There has been another report on hydrogen absorption heat-treatment. With magnetic materials made of 5 to 15 atomic % Sm, 0.5 to 25 atomic % N, and Fe or Fe and Co in the remaining part, a fine particle of Sm-Fe alloy is readily oxidized. Therefore, a method is disclosed in the report whereby alloy in a large lump form, i.e., a large alloy ingot in which a region at a distance of 0.25 mm or more from the surface exists can be nitrogenated. In this method, an alloy ingot is subjected to hydrogen absorption heat-treatment to be allowed to absorb hydrogen, after which the alloy ingot is subjected to nitrogenating heat-treatment in an atmosphere of nitrogen gas, thus enabling alloy of a large size to be fully and uniformly nitrogenated. The above-described report explains that fine passage for gas is formed in alloy in hydrogen absorption heat-treatment so that nitrogen enters to the deep portion in the alloy through the resulting gas passage in nitrogenating heat-treatment. Also, as disclosed in the report, in this hydrogen absorption heat-treatment, the temperature is 350° C. or less, and especially preferable in the range of 100° to 300° C. It is also important that hydrogen absorption heat-treatment is not conducted twice or more. When hydrogen absorption heat-treatment is conducted only one time, alloy is not reduced to fine powder, remaining of a large size (See, Japanese Laid-Open Patent Publication No.4-280605).

As a nitrogenating process (4), conducted are a method whereby $Sm_2Fe_{17}$ is exposed to a stream of hydrogen-ammonia gas mixture at temperatures in the neighborhood of 470° C. (Japanese Laid-Open Patent Publication No.2-257603); and a method whereby alloy is heat-treated in nitrogen gas at the same temperatures and high pressure (of 30 kgf/cm$^2$ or more) (Tatami et al., Digests of the 16th Annual Conference on Magnetics in Japan, 1992, p440, and Japanese Laid-Open Patent Publication No.5-258927). Also, there has been another report as follows: $Sm_2Fe_{17}$ powder coarsely crushed to 53 μm or less is placed in a stream of hydrogen gas at temperatures in the neighborhood of 250° C. for 1 hour to be subjected to hydrogen treatment, after which the powder is placed in a stream of nitrogen gas to be heat-treated at low temperatures (of 450° to 500° C.) for long time (of 20 to 63 hours), thereby inhibiting the decomposition into α-Fe to obtain excellent magnetic characteristics (C.Ishizaka et al., Ferrite: Proceedings of The ICF 6, Tokyo and Kyoto, Japan 1992, pp.1092 to 1095).

As a fine crushing process (5), conventional methods of size reduction by a ball mill or jet mill are performed. According to the above-described paper by C. Ishizaka, the size reduction by means of an attritor provided fine powder with a particle size of 1.5 μm or less, thus achieving excellent magnetic characteristics.

However, Sm-Fe alloy is readily oxidized, and oxidization thereof results in not only a decrease in the amount of $Sm_2Fe_{17}N_x$ which exhibits magnetic characteristics but also appearance of α-Fe. This α-Fe exhibits soft magnetism, and hence becomes the main cause of a decrease in its coercive force as well as deterioration in the rectangularity in hysteresis loop of a 4πI-H curve. Therefore, control on oxidation has become a main problem of determining the quality of magnetic characteristics.

In order to control the oxidation of Sm-Fe alloy, the following methods can be considered.

The melting and casting process (1) and homogenizing heat-treatment process (2) are conducted in the active temperature range in excess of 1000° C. Therefore, the oxygen concentration must be controlled as low as possible. However, since it is difficult to remove oxygen in an atmosphere completely, and also difficult to prevent the atmosphere in the time-consuming homogenizing heat-treatment process from including a small amount of oxygen due to cost and restrictions on facilities, the surface of the obtained alloy ingot is often oxidized.

The coarse crushing process (3) is performed at room temperature, but it can be considered that the temperature becomes considerably high at the scene of crystal break microscopically, and therefore it is preferably performed in an atmosphere of non-oxidizing gas (in many cases nitrogen gas).

The nitrogenating process (4) is performed in the temperature range of 400° C. to 500° C., but nitrogenate is decomposed into α-Fe and SmN at temperatures of about 670° C. or more. Since nitrogenating is an exothermic reaction, it is necessary that the nitrogenating temperature is controlled low so as not to reach the decomposition temperature. On the other hand, since the nitrogenating rate increases with an increase in temperature, there has been a demand for conducting a nitrogenating process at temperatures as high as possible. According to the announcement in academy so far, nitrogenating is performed at about 470° C. in most cases, and it can be said that this temperature is the optimum temperature for minimizing the generation of α-Fe.

However, the time as long as the order of 100 hours is required for completely nitrogenating Sm-Fe alloy at the above-described nitrogenating temperature. Also, the above-described nitrogenating temperature is too low for nitrogen attached to the alloy surface to diffuse into the interior of the Sm-Fe alloy, resulting in low diffusion rate. Reduction in particle size can shorten the nitrogenating time as well as conduct nitrogenating uniformly. Many reports have indicated that the size of particle is 50 μm or less, preferably 20 μm or less.

However, when the particle size of Sm-Fe alloy decreases, the surface area of the particle significantly increases, which causes the alloy to become markedly susceptible to oxidation. Accordingly, the inclusion of the oxygen in a nitrogenating process must be controlled as little as possible.

The fine crushing process (5) is a process for reducing the powder to fine powder with a particle size in the range of 1 to 3 μm, and hence the surface area of the particle significantly expands, making the particle more susceptible to oxidation. Although the treating temperature is room temperature, it can be considered that the temperature at the scene of crystal break becomes high microscopically, requiring the fine crushing process to be performed in a nonoxydizing atmosphere.

From the above-described reasons, in order to prevent Sm-Fe alloy from being oxidized as well as remove α-Fe resulting from oxidation, provided are the following means, each of which has problems as described below.

First, in the homogenizing heat-treatment process (2), it is impossible to remove oxygen in an atmosphere completely as described above, and therefore Sm is oxidized at the surface of alloy ingot by all means. Also, since Sm has a high vapor pressure, Sm at the surface portion of alloy ingot vaporizes, which combines with the above-described oxidation to cause a decrease in the content of Sm at the surface portion of alloy ingot. This causes excess Fe to appear as α-Fe. This α-Fe degrades the magnetic characteristics and hence is required to be removed. Therefore, procedure such as shaving off the surface portion of alloy ingot was conducted in conventional processes, but this procedure is labor-intensive and time-consuming. Accordingly, there has been a demand for the development of efficient removal method.

The coarse crushing process (3) is performed with a crusher being placed in an atmosphere of nitrogen gas and the work is done through rubber gloves, resulting in inferior working efficiency. Also, the amount of nitrogen to be used is large, which leads to an increase in price of magnetic materials. Therefore, improvement thereof has been demanded. Also, mechanical crushing introduces many defects and impurities to the particle surface, contributing to deterioration in final magnetic characteristics.

Further, in order to transfer powder from the coarse crushing process to the subsequent nitrogenating process, once the coarsely crushed powder is taken out in air, and then put into a nitrogenating furnace. In this step, it is required that the inside of the furnace containing powder is evacuated and also the temperature is increased to temperatures in the neighborhood of 200° C. to perform baking of powder and the inside of the furnace, thereby removing molecules of oxygen and water attached to the particle surface and the inwall of the furnace.

In the nitrogenating process (4), nitrogenating by ammonia gas entails the following problems. The gas is harmful, and although nitrogenating can be performed for a short time, only the surface portion tends to be excessively nitrogenated, resulting in deterioration in magnetic characteristics. Also, nitrogenating by nitrogen gas will not lead to excessive nitrogenating, but it is timeconsuming.

In the fine crushing process (5), the use of a ball mill introduces a problem of requiring a time as long as 50 to 100 hours. With a jet mill, there occurs a problem that the amount of nitrogen gas to be used is large. The use of an attritor shortens the time required for the process, but there is still a problem that 3 hours are required under the optimum conditions.

SUMMARY OF THE INVENTION

It is an object of the present invention to provide a production method and apparatus capable of preventing oxidation, removing oxide, and shortening the time required for treatment in order to obtain practical magnetic powder, reconsidering each process in view of the above-described problems.

A method for producing alloy powder of the $R_2T_{17}$ system in accordance with the present invention comprises a homogenizing heat-treatment process for changing an ingot containing R (R: Sm or a substance obtained by replacing a pare of Sm with one or more kinds of rare earth elements) and T (T: Fe or a substance obtained by replacing a part of Fe with one or more kinds of transition elements) as main component into an alloy ingot mainly containing $R_2T_{17}$ having a $Th_2Zn_{17}$ structure; and a coarse crushing process for causing the alloy ingot to absorb hydrogen in hydrogen gas in the temperature range of 70° C. to 300° C., and at pressures of 5 kgf/cm$^2$ or more to obtain $R_2T_{17}$ system alloy powder mainly with a particle size of less than 150 μm.

According to experiments, the minimum hydrogen absorption temperature at pressures of hydrogen gas of 5 kgf/cm$^2$ or more is about 70° C. When an alloy ingot is subjected to hydrogen decrepitation at pressures of hydrogen gas of 5 kgf/cm$^2$ or more, alloy powder with a particle size of less than 150 μm can be obtained in an amount of 90 wt % or more, and the pressure of hydrogen gas increases with an increase in the amount of fine alloy powder. Also, at temperatures of 350° C. or more, hydrogen gas is desorbed from the alloy ingot. Therefore, when an alloy ingot mainly containing $R_2T_{17}$ is allowed to absorb hydrogen in hydrogen gas in the temperature range of 70° C. to 300° C. and at pressures of 5 kgf/cm$^2$ or more, $R_2T_{17}$ system alloy powder with a particle size of less than 150 μm can be surely obtained.

In the above-described method for producing alloy powder of the $R_2T_{17}$ system, it is sufficient that the coarse crushing process comprises a step of causing the alloy ingot to absorb hydrogen only one time. In the prior art, the absorption and desorption of hydrogen is repeated as many times as desired to reduce an alloy ingot to powder, while only onetime treatment of allowing an alloy ingot subjected to homogenizing heat-treatment to absorb hydrogen in hydrogen gas can surely result in $R_2T_{17}$ system alloy powder with a particle size of less than 150 μm, making it possible to simplify the coarse crushing process.

In the above-described method for producing alloy powder of the $R_2T_{17}$ system, it is preferable that the coarse crushing process further comprises a step of breaking the alloy ingot subjected to the homogenizing heat-treatment process to expose resultant new fracture thereof prior to the step of causing the alloy ingot to absorb hydrogen.

Thus, an alloy ingot subjected to homogenizing heat-treatment process is broken to expose resultant new fracture prior to the hydrogen absorption treatment, which causes the film of α-Fe generated on the surface portion of the alloy ingot subjected to the homogenizing heat-treatment process to be broken. Accordingly, the surface of $R_2T_{17}$ comes in direct contact with hydrogen gas, and hence first, hydrogen is absorbed at the exposed fracture. Then, the alloy ingot started to be reduced to powder from the exposed fracture, and the portions covered with the film of α-Fe are successively reduced to powder, making it possible to reduce the whole alloy ingot to powder.

In the above-described method for producing alloy powder of the $R_2T_{17}$ system, it is preferable that the coarse crushing process further comprises a step of classifying the $R_2T_{17}$ system alloy powder to obtain $R_2T_{17}$ system alloy powder with a particle size of less than 150 μm.

Thus, the film of α-Fe generated on the surface portion of an alloy ingot in melting and casting process and homogenizing heat-treatment process will not absorb hydrogen, and hence will not be reduced to powder. Also, since the thickness of the film of α-Fe is about 200 μm or more, when alloy powder subjected to the coarse crushing process by hydrogen absorption is classified into only the powder with a particle size of less than 150 μm, resulting alloy powder contains no film of α-Fe, and mostly $R_2T_{17}$ system alloy powder. Therefore, alloy powder having excellent magnetic characteristics can be obtained.

In the above-described method for producing alloy powder of the $R_2T_{17}$ system, it is preferable that the coarse crushing process comprises the steps of accommodating the homogenizing heat-treated alloy ingot into a high pressure vessel together with a hard ball which will not absorb hydrogen; causing the alloy ingot to absorb hydrogen in the high pressure vessel; and vibrating the high pressure vessel.

Thus, a large quantity of $R_2T_{17}$ alloy is attached to the film of α-Fe at the surface portion of the alloy ingot subjected to homogenizing heat-treatment after hydrogen decrepitation. When a high pressure vessel is vibrated to cause the film of α-Fe to which $R_2T_{17}$ system alloy is attached to collide against a hard ball and the inwall of the high pressure vessel, the $R_2T_{17}$ system alloy can be separated from the film of α-Fe. This can enhance the yield of $R_2T_{17}$ system alloy powder with a particle size of less than 150 μm and excellent magnetic characteristics.

The first method for producing magnetic powder of the $R_2T_{17}N_x$ system of the present invention comprises a homogenizing heat-treatment process for changing an ingot containing R (R: Sm or a substance obtained by replacing a part of Sm with one or more kinds of rare earth elements) and T (T: Fe or a substance obtained by replacing a part of Fe with one or more kinds of transition elements) as main component into an alloy ingot mainly containing $R_2T_{17}$ having a $Th_2Zn_{17}$ structure; a coarse crushing process for putting the alloy ingot into a high pressure vessel and replacing the atmosphere in the high pressure vessel with hydrogen gas atmosphere, after which the alloy ingot is caused to absorb hydrogen in hydrogen gas in the temperature range of 70° C. to 300° C., and at pressures of 5 kgf/cm$^2$ or more to change the alloy ingot into $R_2T_{17}$ system alloy powder mainly with a particle size of less than 150 μm; a gas replacement process for changing a hydrogen gas atmosphere into a nitrogen gas atmosphere in the high pressure vessel; a nitrogenating process for nitrogenating the $R_2T_{17}$ system alloy powder in the high pressure vessel subjected to gas replacement to obtain $R_2T_{17}N_x$ system alloy powder mainly with a particle size of less than 150 μm; and a fine crushing process for finely crushing the $R_2T_{17}N_x$ system alloy powder to obtain $R_2T_{17}N_x$ system magnetic powder with a particle size of 3 μm or less.

Thus, when $R_2T_{17}$ system alloy powder and $R_2T_{17}N_x$ system magnetic powder are subjected to the coarse crushing process through nitrogenating process in a single high pressure vessel, easy-to-oxidize $R_2T_{17}$ system alloy powder and $R_2T_{17}N_x$ system magnetic powder can be treated without coming in contact with air. Therefore, the generation of oxide thereof can be controlled extremely as little as possible, resulting in $R_2T_{17}N_x$ system magnetic powder having excellent magnetic characteristics.

In the first method for producing magnetic powder of the $R_2T_{17}N_x$ system, it is preferable that the coarse crushing process further comprises a step of breaking the alloy ingot subjected to the homogenizing heat-treatment process to expose resultant new fracture thereof prior to the step of causing the alloy ingot to absorb hydrogen.

Thus, when an alloy ingot subjected to the homogenizing heat-treatment process is broken to expose resultant new fracture, and then the broken alloy ingot is put into a high pressure vessel, the film of α-Fe generated on the surface portion of the alloy ingot subjected to the homogenizing heat-treatment process is broken to cause the fracture of $R_2T_{17}$ system alloy to come in direct contact with hydrogen gas. This facilitates hydrogen absorption so that the broken alloy ingot started to be reduced to powder from the exposed fracture side thereof, leading to pulverization of the whole alloy ingot. Also, the subsequent nitrogenating is performed in the same high pressure vessel without coming in contact with air, which controls oxidation, resulting in $R_2T_{17}N_x$ system magnetic powder having excellent magnetic characteristics.

In the first method for producing magnetic powder of the $R_2T_{17}N_x$ system, it is preferable that the first method further comprises a process for classifying the $R_2T_{17}N_x$ system alloy powder to obtain $R_2T_{17}N_x$ system alloy powder with a particle size of less than 150 μm, between the nitrogenating process and the fine crushing process.

Since alloy powder subjected to nitrogenating process is classified to provide only the powder with a particle size of less than 150 μm for a fine crushing process, the film of α-Fe generated on the surface portion of the alloy ingot in a melting and casting process and homogenizing heat-treatment process is removed by the classification. The film of α-Fe will not undergo hydrogen decrepitation, and change in the subsequent nitrogenating, and hence remains as a thin film of a thickness in excess of 150 μm. Therefore, most of the resultant powder is $R_2T_{17}N_x$ system magnetic powder, resulting in $R_2T_{17}N_x$ system magnetic powder having excellent magnetic characteristics.

In the first method for producing magnetic powder of the $R_2T_{17}N_x$ system, it is preferable that the gas replacement process further comprises the steps of evacuating the inside of the high pressure vessel to $10^{-4}$torr or less in the temperature range of 350° C. to 570° C. to desorb hydrogen from the $R_2T_{17}$ system alloy powder; and injecting nitrogen gas in the high pressure vessel in the temperature range suitable for the nitrogenating process.

In the $R_2T_{17}$ system alloy powder pulverized in the coarse crushing process, hydrogen is absorbed, and if nitrogenating is conducted as it is, hazardous ammonia gas is generated at the time of nitrogenating. However, the high pressure vessel is evacuated to $10^{-4}$torr or less in the temperature range in which hydrogen gas is desorbed of 350° C. to 570° C., and hence hydrogen gas can be almost completely desorbed from alloy powder. This makes it possible to control the generation of hazardous ammonia gas in the subsequent nitrogenating process.

In the first method for producing magnetic powder of the $R_2T_{17}N_x$ system, it is preferable that the nitrogenating process further comprises a step of maintaining the $R_2T_{17}$ system alloy powder in nitrogen gas in the temperature range of 560° C. to 580° C. and at pressures of 50 kgf/cm$^2$ or more for 4 hours or more to nitrogenate the $R_2T_{17}$ system alloy powder.

Thus, when $R_2T_{17}$ system alloy powder is nitrogenated in nitrogen gas at pressures of 50 kgf/cm$^2$ or more, heat of reaction is well transmitted. Therefore, nitrogenating can be performed at temperatures as high as 560° C. to 580° C. in which the diffusion rate of nitrogen is high, shortening the time required for nitrogenating.

In the first method for producing magnetic powder of the $R_2T_{17}N_x$ system, it is preferable that the nitrogenating process further comprises a step of maintaining the $R_2T_{17}$ system alloy powder in nitrogen gas in the temperature range of 400° C. to 500° C. and at pressures in the range of atmospheric pressure to 30 kgf/cm$^2$, and then maintaining the $R_2T_{17}$ system alloy powder in nitrogen gas in the temperature range of 560° C. to 620° C. and at pressures in the range of 40 kgf/cm$^2$ to 80 kgf/cm$^2$ to nitrogenate the $R_2T_{17}$ system alloy powder.

When $R_2T_{17}$ system alloy powder is maintained in nitrogen gas at pressures in the range of atmospheric pressure to 30 kgf/cm$^2$ in low temperature range of 400° C. to 500° C., nitrogenating reaction is slowly effected. Therefore, reaction is effected only at the easy-to-react surface portion of particles. Then, the powder is maintained in nitrogen gas at pressures in the range of 40 kgf/cm$^2$ to 80 kgf/cm$^2$ in high temperature range of 560° C. to 620° C., accelerating the diffusion of nitrogen into particles and nitrogenating reaction within the particles. Thus, the combination of low pressure gas nitrogenating in the low temperature range with high pressure gas nitrogenating in the high temperature range can more shorten the time required for nitrogenating.

In the first method for producing magnetic powder of the $R_2T_{17}N_x$ system, it is preferable that the coarse crushing process comprises the steps of accommodating the alloy ingot subjected to the homogenizing heat-treatment process into the high pressure vessel together with a hard ball which will not absorb hydrogen; and causing the alloy ingot to absorb hydrogen in the high pressure vessel, and that the first method for producing $R_2T_{17}N_x$ system magnetic powder further comprises a process of vibrating the high pressure vessel to crush the $R_2T_{17}N_x$ system alloy powder, followed by classification to remove powder with a particle size in excess of 150 μm, obtaining $R_2T_{17}N_x$ system magnetic powder with a particle size of less than 150 μm after nitrogenating process.

In the melting and casting process and homogenizing heat-treatment process, the film of α-Fe is generated on the surface portion of the alloy ingot. To this film of α-Fe attached is a large quantity of $R_2T_{17}$ system alloy after hydrogen decrepitation. The $R_2T_{17}$ system alloy is changed into $R_2T_{17}N_x$ system alloy by nitrogenating. However, when a high pressure vessel is vibrated, the film of α-Fe with $R_2T_{17}N_x$ system alloy attached thereto is caused to collide with hard balls and the inwall of the high pressure vessel. This makes it possible to separate the $R_2T_{17}N_x$ system alloy from the film of α-Fe. Classification thereof can remove the film of α-Fe. Accordingly, $R_2T_{17}N_x$ system magnetic powder with excellent magnetic characteristics can be obtained with high yield.

The second method for producing magnetic powder of the $R_2T_{17}N_x$ system in accordance with the present invention comprises a homogenizing heat-treatment process for heating an ingot containing R (R: Sm or a substance obtained by replacing a part of Sm with one or more kinds of rare earth elements) and T (T: Fe or a substance obtained by replacing a part of Fe with one or more kinds of transition elements) as main component in an inert gas at pressure higher than the vapor pressure of the R and the vapor pressure of the T up to the temperature range of 1010° C. or more and less than 1280° C. to obtain an alloy ingot mainly containing $R_2T_{17}$ having a $Th_2Zn_{17}$ structure; a coarse crushing process for supplying hydrogen gas to the alloy ingot in the temperature range of 350° C. to 70° C. in which the heated alloy ingot is in process of cooling, which causes the alloy ingot to absorb hydrogen, obtaining $R_2T_{17}$ system alloy powder with a particle size of less than 150 μm; a nitrogenating process for supplying nitrogen gas to the $R_2T_{17}$ system alloy powder in the temperature range of 400° C. to 620° C. to nitrogenate the $R_2T_{17}$ system alloy powder, obtaining $R_2T_{17}N_x$ system alloy powder; and a fine crushing process for finely crushing the $R_2T_{17}N_x$ system alloy powder to obtain $R_2T_{17}N_x$ system magnetic powder with a particle size of 3 μm or less.

According the second method for producing magnetic powder of the $R_2T_{17}N_x$ system, since ingot containing R and T as main component is heated in an inert gas at pressure higher than the vapor pressure of R and T to obtain an alloy ingot mainly containing $R_2T_{17}$, Sm is not allowed to escape in the form of vapor from the surface portion of the alloy ingot, resulting in no formation of the thin film of α-Fe. Also, since the alloy ingot is subjected to hydrogen decrepitation in the temperature range of 350° C. to 70° C. in which the alloy ingot heated in the homogenizing heat-treatment process was in process of cooling, the process for heating the alloy ingot for hydrogen decrepitation becomes unnecessary, making it possible to simplify the process.

The third method for producing magnetic powder of the $R_2T_{17}N_x$ system in accordance with the present invention comprises a raw material accommodating process for accommodating an alloy ingot containing R (R: Sm or a substance obtained by replacing a part of Sm with one or more kinds of rare earth elements) and T (T: Fe or a substance obtained by replacing a part of Fe with one or more kinds of transition elements) as main component, and mainly containing $R_2T_{17}$ having a $Th_2Zn_{17}$ structure, into a horizontally maintained high pressure vessel so that the space portion is formed at the upper portion of the inside thereof; a coarse crushing process for supplying hydrogen gas into the high pressure vessel so that the alloy ingot is caused to absorb hydrogen to obtain $R_2T_{17}$ system alloy powder with a particle size of less than 150 μm; a hydrogen gas exhaust process for exhausting hydrogen gas in the high pressure vessel; a nitrogenating process for supplying nitrogen gas into the high pressure vessel so that the $R_2T_{17}$ system alloy powder is nitrogenated to obtain $R_2T_{17}N_x$ system alloy powder; and a fine crushing process for finely crushing the $R_2T_{17}N_x$ system alloy powder to obtain $R_2T_{17}N_x$ system magnetic powder with a particle size of 3 μm or less.

According to the third method for producing magnetic powder of the $R_2T_{17}N_x$ system, since $R_2T_{17}$ system alloy powder is accommodated in a high pressure vessel so that the space portion is formed at the upper portion of the inside thereof, at the time of supplying hydrogen gas or nitrogen gas, each gas moves through the space portion to reach the whole alloy powder. Therefore, hydrogen absorption or nitrogenating is surely conducted, and also when hydrogen gas is exhausted to effect desorption of hydrogen, hydrogen gas moves through the space portion. Therefore, the desorption of hydrogen gas can be smoothly conducted. When hydrogen gas or nitrogen gas distant from the gas exhaust port is exhausted, powder near the gas exhaust port will not be whirled in the exhausted hydrogen or nitrogen gas.

The coarse crushing process for subjecting $R_2T_{17}$ system alloy powder to hydrogen decrepitation by hydrogen gas, and the nitrogenating process for nitrogenating $R_2T_{17}$ system alloy powder by nitrogen gas are conducted in the same high pressure vessel. Therefore, the alloy powder can be prevented from being oxidized between the coarse crushing process and nitrogenating process, and also the time required for treatment can be shortened.

The fourth method for producing magnetic powder of the $R_2T_{17}N_x$ system of the present invention comprises a nitrogenating process for nitrogenating $R_2T_{17}$ system alloy powder with a $Th_2Zn_{17}$ structure containing R (R: Sm or a substance obtained by replacing a part of Sm with one or more kinds of rare earth elements) and T (T: Fe or a substance obtained by replacing a part of Fe with one or more kinds of transition elements) as main component to obtain $R_2T_{17}N_x$ system alloy powder; a suspension process for mixing and suspending the $R_2T_{17}N_x$ system alloy powder in organic solvent to obtain mixed suspension; and a fine crushing process for applying high pressure to the mixed suspension so that the mixed suspension is introduced into a bifurcate passage to cause high velocity impact of the mixed suspension in each divergent passage with each other, which finely crushes the $R_2T_{17}N_x$ system alloy powder to obtain $R_2T_{17}N_x$ system magnetic powder with a particle size of 3 μm or less.

According to the fourth method for producing magnetic powder of the $R_2T_{17}N_x$ system, $R_2T_{17}N_x$ system alloy powder is mixed and suspended in organic solvent to obtain mixed suspension, which is then caused to collide with each other at high velocity to finely crush the nitrogenated alloy powder. Thus, the nitrogenated alloy powder is crushed in an instant, making it possible to decrease the deterioration in magnetic characteristics and also to shorten the time required for crushing. Also, organic solvent can be recycled, resulting in lower running cost.

The fifth method for producing magnetic powder of the $R_2T_{17}N_x$ system of the present invention comprises a nitrogenating process for nitrogenating $R_2T_{17}$ system alloy powder with a $Th_2Zn_{17}$ structure containing R (R: Sm or a substance obtained by replacing a part of Sm with one or more kinds of rare earth elements) and T (T: Fe or a substance obtained by replacing a part of Fe with one or more kinds of transition elements) as main component to obtain $R_2T_{17}N_x$ system alloy powder; a suspension process for mixing and suspending the $R_2T_{17}N_x$ system alloy powder, and at least one of thermosetting organic resin and latent curing agent in organic solvent to obtain mixed suspension; a fine crushing process for applying high pressure to the mixed suspension so that the mixed suspension is introduced into a bifurcate passage to cause high velocity impact of the mixed suspension in each divergent passage with each other, which finely crushes the $R_2T_{17}N_x$ system alloy powder to obtain fine powder with a particle size of 3 μm or less; and an organic solvent removing process for removing the organic solvent from the mixed suspension so that at least one of thermosetting organic resin and latent curing agent is attached to the surface of the fine powder to obtain $R_2T_{17}N_x$ system magnetic powder with a particle size of 3 μm or less.

According to the fifth method for producing magnetic powder of the $R_2T_{17}N_x$ system, $R_2T_{17}N_x$ system alloy powder and at least one of thermosetting organic resin and latent curing agent are mixed and suspended in organic solvent to obtain mixed suspension, which is then caused to collide with each other at high velocity to finely crush the nitrogenated alloy powder. Thus, in the same manner as in the fourth method, the deterioration in magnetic characteristics can be decreased and also the time required for crushing can be shortened. Also, organic solvent can be recycled, resulting in lower running cost. Further, organic solvent is removed from the mixed suspension with at least one of the thermosetting organic resin and latent curing agent being attached to the surface of the nitrogenated alloy powder. Accordingly, a part of the process for making bonded magnet can be incorporated in the fine crushing process, resulting in shortening and simplification of the process.

A high pressure heat-treatment apparatus in accordance with the present invention comprises a high pressure vessel made of cylindrical metal for accommodating $R_2T_{17}$ system alloy powder with a $Th_2Zn_{17}$ structure containing R (R: Sm or a substance obtained by replacing a part of Sm with one or more kinds of rare earth elements) and T (T: Fe or a substance obtained by replacing a part of Fe with one or more kinds of transition elements) as main component; and a heating furnace for holding the high pressure vessel in a horizontal posture to conduct heating thereof.

According to the above-described high pressure heat-treatment apparatus, since a high pressure vessel made of cylindrical metal for accommodating $R_2T_{17}$ system alloy powder is provided, the temperature increasing and decreasing rate is raised, making it possible to shorten the time required for treatment. Also, a heating furnace for maintaining the high pressure vessel in a horizontal posture to conduct heating thereof is provided. Therefore, alloy powder can be accommodated in the high pressure vessel so that the space portion is formed at the upper portion therein, easily realizing the third production method.

In the above-described high pressure heat-treatment apparatus, it is preferable that the heating furnace is a fluidized bed furnace.

Thus, when the heating furnace is a fluidized bed furnace, the temperature of the high pressure vessel can be increased at high speed, and uniform temperature distribution can be obtained. Also, at the time of treatment on a plurality of temperature conditions, by the use of a plurality of high pressure vessels and fluidized bed furnaces, a plurality of the high pressure vessels are successively immersed in each fluidized bed furnace having different temperature conditions with a batch process, making it possible to treat a large quantity of alloy powder.

DETAILED DESCRIPTION OF THE INVENTION

Figure 1:
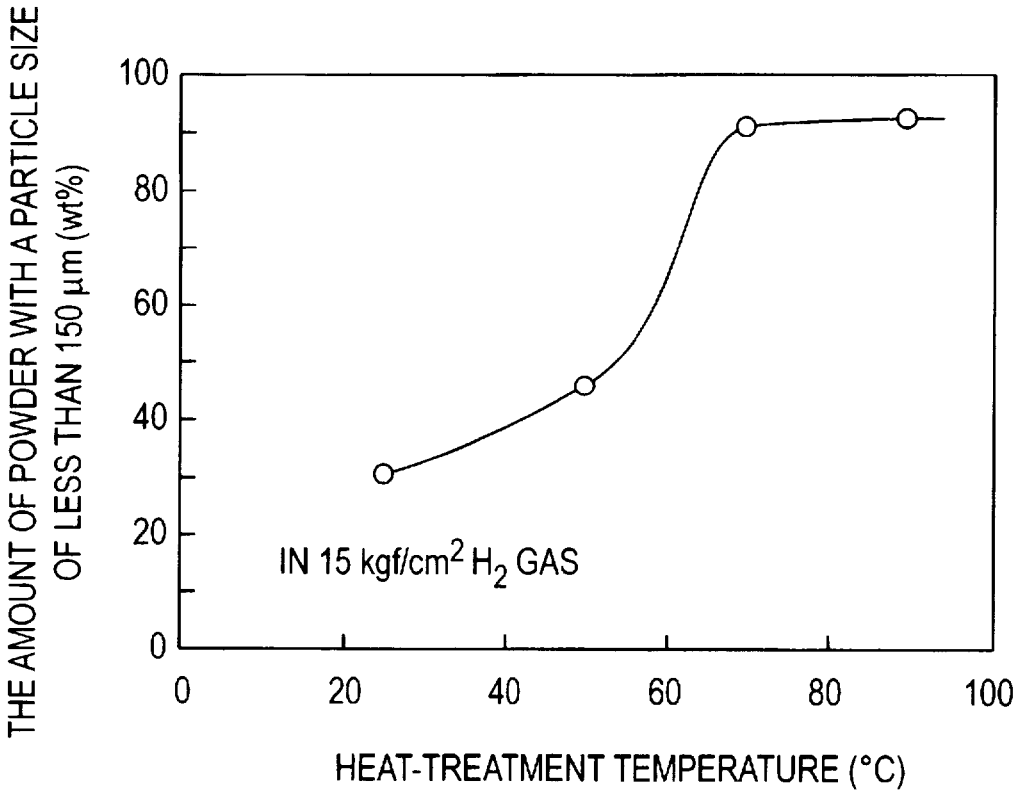
FIG. 1 is a view showing the relationship between the heat-treatment temperature of hydrogen decrepitation and the amount of powder with a particle size of less than 150 μm in example 1 of the present invention.

Below, examples of the present invention will now be described in detail.

I. Coarse crushing process

As described above, the coarse crushing process of $R_2T_{17}$ system alloy (wherein R is Sm, or a substance obtained by replacing a part of Sm with one or more kinds of rare earth elements; and T is Fe, or a substance obtained by replacing a part of Fe with one or more kinds of transition elements) is a process for crushing alloy ingot into powder with a particle size of less than 150 μm so that the subsequent nitrogenating process can be performed for a short time and uniformly. The reason why the particle size of the powder formed in this coarse crushing process is determined as less than 150 μm will be explained in detail below. Since the nitrogenating process of the present invention is conducted in high pressure nitrogen gas after hydrogen decrepitation or after desorption of hydrogen from the alloy powder subjected to hydrogen decrepitation, there is no need to make the particle size of the powder as small as 50 μm or less, or 20 μm as in conventional coarse crushing processes. Even the powder with a particle size of 150 μm can be nitrogenated for a short time and uniformly. Also, various mechanical crushing methods have been studied so far. However, these methods entail many problems such as prevention of oxidation, crystal defect, and impurities. Moreover, since crushing is conducted in a glove box including costly nitrogen gas, resulting in high cost.

To this, the inventors of the present invention have studied coarse crushing by means of hydrogen absorption. It has been said that alloy made of $Sm_2Fe_{17}$ cannot be subjected to coarse crushing treatment by hydrogen decrepitation. However, they have found that an increase in the pressure of hydrogen gas enables the coarse crushing treatment by means of hydrogen absorption.

Example 1

First, $Sm_2Fe_{17}$ alloy ingot subjected to homogenizing heat-treatment was broken to prepare alloy ingots each with a size in the range of 2 mm to 8 mm. The reason why the size of alloy ingot is made 2 mm to 8 mm is that the inlet of a highpressure vessel used is small, and it is not construed that the size of alloy ingot is limited to the above-described size. A part of these alloy ingots were put in a mortar and crushed until the whole passed through a sieve of 45 μm. The powder obtained by crushing was subjected to X-ray diffraction and thermomagnetic analysis to confirm that the most of the powder was $Sm_2Fe_{17}$. It was also found that $SmFe_3$ and α-Fe were contained in small amount.

A part of the above-described alloy ingot was subjected to component analysis. This analysis showed that Sm constituted 25.3 percent by weight (wt %), slightly higher than the Sm content in the stoichiometric composition of $Sm_2Fe_{17}$ of 24.05 wt %. In addition, judging from the results of X-ray diffraction, thermomagnetic analysis, and structure observation by a metallurgical microscope, it can be considered that fine $SmFe_3$ is allowed to deposit partially in extremely small amount in $Sm_2Fe_{17}$ alloy ingot subjected to homogenizing heat-treatment.

Next, log of $Sm_2Fe_{17}$ alloy particles each with a size in the range of 2 mm to 8 mm were put into a high pressure vessel with a content volume of 140 cc, and the atmosphere in the high pressure vessel was replaced with hydrogen atmosphere. Thereafter, the pressure of hydrogen was set to 15 kgf/cm$^2$ at room temperature to hermetically seal the high pressure vessel, after which the high pressure vessel was inserted in a heat-treatment furnace set to a constant temperature of 90° C. to measure the temperature of the high pressure vessel and the pressure of hydrogen in the high pressure vessel. The hydrogen pressure started to drop from temperatures in the neighborhood of about 70° C., and the drop in the hydrogen pressure was terminated in about 2 hours, thus confirming that hydrogen absorption was almost completed.

Next, the high pressure vessel was taken out from the heat-treatment furnace, and cooled to room temperature. Then, the high pressure vessel was opened to take out $Sm_2Fe_{17}$ alloy, after which the alloy was classified with a sieve of 150 μm. The classification showed that 90 wt % or more of the alloy particles which had had a size of 2 mm or more prior to hydrogen absorption treatment were reduced to powder with a particle size of less than 150 μm. This revealed that the alloy underwent hydrogen decrepitation.

Figure 2:
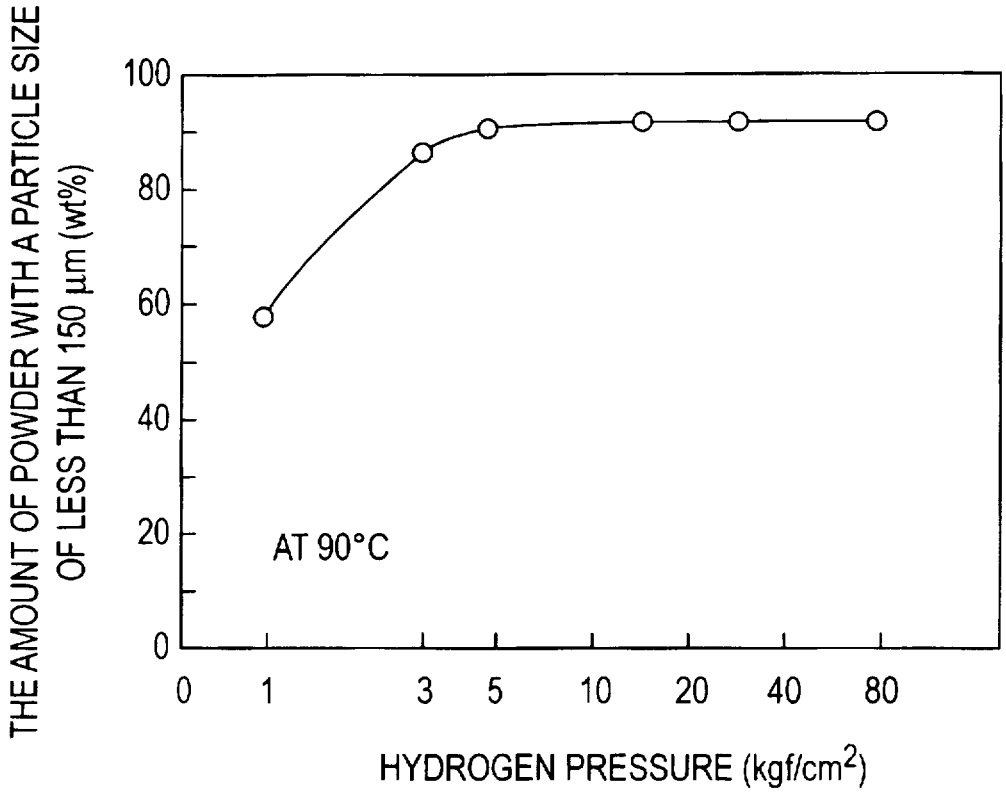
FIG. 2 is a view showing the relationship between the hydrogen pressure of hydrogen decrepitation and the amount of powder with a particle size of less than 150 μm in example 1 of the present invention.

The same experiment was conducted except that the heat-treatment temperature (constant temperature of a heat-treatment furnace) and hydrogen pressure (initial pressure at room temperature) were changed. FIGS. 1 and 2 show the resultant relationship between the heat-treatment temperature (constant temperature of a heat-treatment furnace) and the hydrogen pressure (initial pressure at room temperature), and the particle size distribution, respectively.

As for the hydrogen absorption temperature, $Sm_2Fe_{17}$ was 250° C. and $SmFe_3$ was 200° C. at atmospheric pressure as already revealed in papers. But this experiment showed that the hydrogen pressure increased with a decrease in the hydrogen absorption temperature. Also, this experiment showed that the minimum hydrogen absorption temperature was about 70° C. at hydrogen gas pressures of 5 kgf/cm$^2$ or more. It was also revealed that the hydrogen gas pressure increased with a gradual increase in the amount of fine powder and that a hydrogen gas pressure of 5 kgf/cm$^2$ or more resulted in 90 wt % or more of powder with a particle size of less than 150 μm required for nitrogenating.

From the above description, it was confirmed that when hydrogen absorption was performed at temperatures as low as 70° C. or more close to room temperature, and hydrogen pressures of 5 kgf/cm$^2$ or more, the alloy could be reduced to powder to such a extent that powder with a particle size of less than 150 μm is contained in an amount of 90 wt % or more. This alloy ingot contains $SmFe_3$ in small amount as described above, but the hydrogen absorption treatment in this example is performed at temperatures of 70° C. to 90° C. substantially lower than the hydrogen absorption temperature of $SmFe_3$ of 200° C., and different from conventional hydrogen decrepitation under atmospheric pressure.

As for the maximum hydrogen absorption temperature, it has already been revealed that at atmospheric pressure $Sm_2Fe_{17}$ undergoes sharp hydrogen absorption at 250° C., and starts to desorb hydrogen at temperatures exceeding 350° C. Therefore, the maximum temperature at which hydrogen absorption is well performed is about 300° C. The coarse crushing process in which highly hazardous high pressure hydrogen gas is handled is preferably performed at temperature as low as possible for safety reasons. As for the hydrogen gas pressure, higher pressure is preferable, because the hydrogen absorption rate increases with increasing pressure. However, the maximum hydrogen gas pressure is 80 kgf/cm$^2$ because of the pressure resistance of the high pressure vessel to be used in experiments so far.

Example 2

A Sm-Fe molten ingot was subjected to homogenizing heat-treatment by use of 99.999% argon gas as atmospheric gas at 1100° C. for 12 hours. This alloy ingot subjected to homogenizing heat-treatment was broken to prepare small ingots, one of which was put in a mortar and crushed until the whole passed through a sieve of 45 μm. The crushed powder was subjected to X-ray diffraction, component analysis, and thermomagnetic analysis to confirm that the most of the powder was $Sm_2Fe_{17}$. It was also found that α-Fe was contained in the alloy ingot in small amount. The results of the component analysis of the alloy ingot showed that the Sm content was 23.8 wt %, less than that of $Sm_2Fe_{17}$ of 24.05 wt %.

Figure 3:
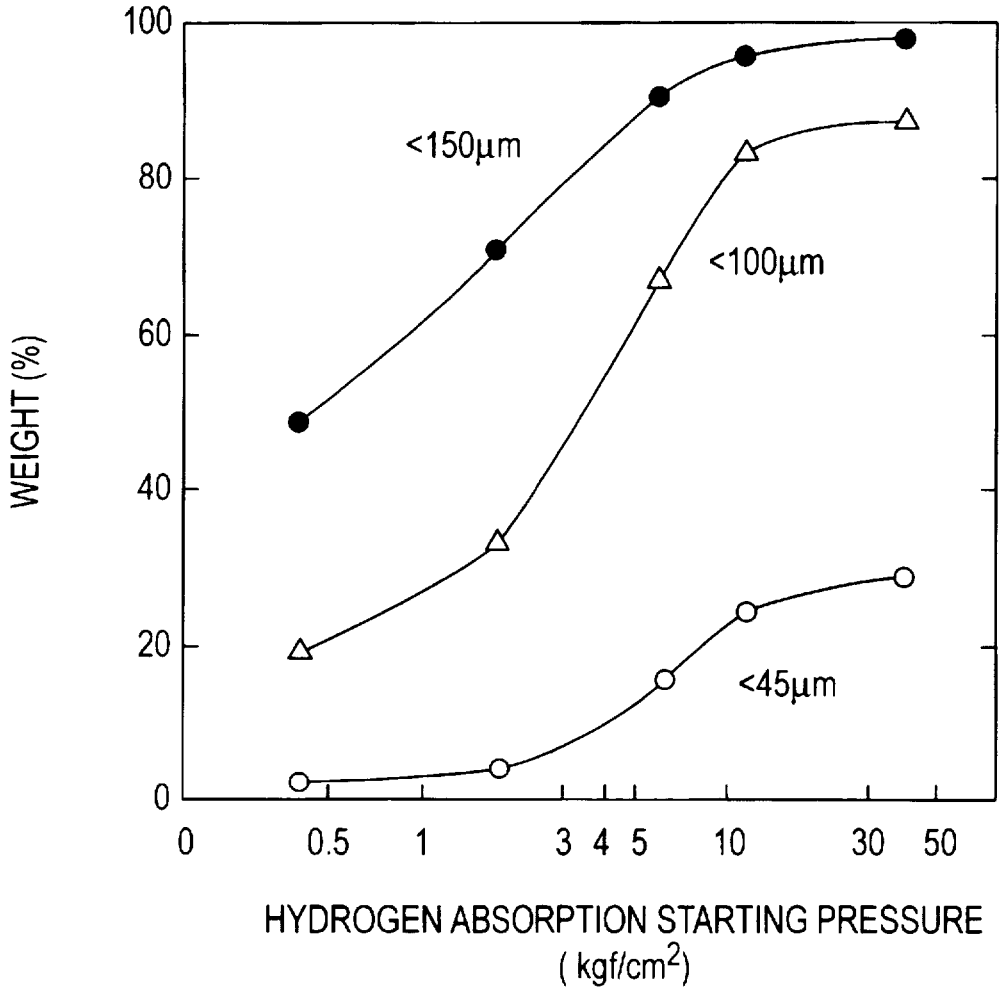
FIG. 3 is a view showing the relationship between the pressure at which hydrogen absorption starts and the particle size distribution in example 2 of the present invention.

The above-described small $Sm_2Fe_{17}$ alloy ingot subjected to homogenizing heat-treatment was broken much smaller to prepare particles of 2 mm to 8 mm with resulting new fracture being exposed. Ten gram of these particles were put into a high pressure vessel with a content volume of 140 cc, and the atmosphere in the high pressure vessel was replaced with hydrogen. Thereafter, the pressure of hydrogen was set to 0kgf/cm2 (atmospheric pressure) at room temperature to hermetically seal the high pressure vessel, after which the high pressure vessel was inserted in a heat-treatment furnace, and the temperature of the high pressure vessel was raised from room temperature at a temperature increasing rate of 5° C./min to measure the temperature of the high pressure vessel and the pressure of hydrogen in the high pressure vessel. The hydrogen pressure started to drop from temperatures in the neighborhood of about 250° C., and the drop in the hydrogen pressure was almost terminated at 270° C., almost completing hydrogen absorption. The hydrogen pressure when it started to drop, that is, when hydrogen absorption started, was 0.4 kgf/cm$^2$ because hydrogen gas was expanded due to the elevated temperature of the high pressure vessel. The temperature was further raised to 350° C., after which the high pressure vessel was taken out from the heat-treatment furnace, and cooled to room temperature. The hydrogen pressure at room temperature was found to be −0.5 kgf/cm$^2$, and there still remained a small amount of hydrogen gas. Then, the high pressure vessel was opened to take out $Sm_2Fe_{17}$ alloy, finding that the alloy was crushed but that many large particles existed. Next, these particles were classified with sieves of 150, 100, and 45 μm. The same experiment was conducted except that the hydrogen pressure was changed to 1, 5, 10, and 30 kgf/cm$^2$. The results are shown in FIG.3. FIG.3 shows the relationship between the hydrogen absorption starting pressure and the particle size distribution of the powder.

It was revealed that the hydrogen gas pressure increased with an increase in the amount of fine particles and that a hydrogen gas pressure of 5 kgf/cm$^2$ or more resulted in 90 wt % or more of powder with a particle size of less than 150 μm suitable for nitrogenating. Also, the hydrogen absorption temperature is in the neighborhood of 250° C. at atmospheric pressure as already revealed in the above-described papers. But when the hydrogen pressure is increased, the temperature at which hydrogen absorption starts decreases. In a method in which the temperature is raised from room temperature, the temperature at which hydrogen absorption starts changes depending on the temperature increasing rate. With a hydrogen pressure of 5 kgf/cm$^2$, it is in the neighborhood of 150° C. at a temperature increasing rate of 5° C./min. A decrease in the temperature increasing rate (when temperature is slowly increased), the minimum temperature at which hydrogen absorption starts is in the neighborhood of 70° C.

Example 3

A Sm-Fe molten ingot was cut to prepare a large number of rectangular parallelepipeds each having a cross section of about 8 mm square. Then the obtained small ingots were subjected to homogenizing heat-treatment by use of 99.999% argon gas as atmospheric gas at 1100° C. for 12 hours. One of these small alloy ingots subjected to homogenizing heat-treatment was put in a mortar and crushed until the whole passed through a sieve of 45 μm. The crushed powder was subjected to X-ray diffraction, component analysis and thermomagnetic analysis to confirm that the most of the powder was $Sm_2Fe_{17}$. It was also found that α-Fe was contained in small amount. The results of the component analysis showed that Sm content was 22.8 wt %, less than that of $Sm_2Fe_{17}$ of 24.05 wt %. The surface portion of the alloy ingot was covered with a film of α-Fe, which had a thickness of about 100 μm to 200 μm at its thick portion. This is attributable to the fact as follows: Sm vaporized at the time of homogenizing heat-treatment, and also Sm was preferentially oxidized to be oxide, which resulted in lack of Sm at the surface portion of the alloy to cause excess Fe to become α-Fe.

One of the above-described rectangular parallelepipeds made of $Sm_2Fe_{17}$ alloy subjected to homogenizing heat-treatment was broken small to prepare particles of 2 mm to 8 mm with resulting new fracture being exposed. Ten gram of these particles were put into a high pressure vessel with a content volume of 140 cc, and the atmosphere in the high pressure vessel was replaced with hydrogen. Thereafter, the pressure of hydrogen was set to 10 kgf/cm$^2$ at room temperature to hermetically seal the high pressure vessel. Then, the high pressure vessel was inserted in a heat-treatment furnace set to a constant temperature of 150° C. to measure the temperature of the high pressure vessel and the pressure of hydrogen in the high pressure vessel. The hydrogen pressure started to drop from temperatures in the neighborhood of about 100° C., and the drop in the hydrogen pressure was terminated in about 1 hour, almost completing hydrogen storage.

Next, the high pressure vessel was taken out from the heat-treatment furnace, and cooled to room temperature. Then, the high pressure vessel was opened to take out $Sm_2Fe_{17}$ alloy, followed by classification with a sieve of 150 μm. This showed that 90 wt % or more of the particles which had had a size of 2 mm or more prior to the treatment were reduced to powder with a particle size of less than 150 μm, confirming that hydrogen decrepitation was conducted.

Next, the same experiment on hydrogen absorption as described above was conducted. When the hydrogen absorption was completed, hydrogen was released. In addition, while the hydrogen gas in the high pressure vessel was being exhausted by means of an evacuator, the high pressure vessel was inserted in another heat-treatment furnace set to a constant temperature of 400° C., and the temperature of the high pressure vessel was raised to 400° C. to completely evacuate the inside of the high pressure vessel to $10^{-4}$torr. These steps enabled the absorbed hydrogen to be desorbed. Thereafter, the high pressure vessel was taken out from the heat-treatment furnace to be cooled, and inserted again in the heat-treatment furnace of 150° C. Then, hydrogen gas was injected and the hydrogen pressure was set to 10 kgf/cm$^2$ to hermetically seal the high pressure vessel, conducting hydrogen absorption again. Such absorption and desorption of hydrogen were conducted each four time, and finally the temperature was decreased to room temperature to open the high pressure vessel and take out $Sm_2Fe_{17}$ alloy. This $Sm_2Fe_{17}$ alloy was classified with a sieve of 150 μm to find that powder with a particle size of less than 150 μm was 92 wt % of the recovered samples. Even if the cycle of absorption and desorption of hydrogen was repeated in a plurality of times, as compared with the value of 91 wt % in the case of one-time hydrogen absorption, the particle size distribution of the crushed powder was slightly influenced. Accordingly, it could be confirmed that one-time hydrogen absorption enables sufficient hydrogen decrepitation.

Example 4

One of the rectangular parallelepipeds each with a cross section of about 8 mm square made of $Sm_2Fe_{17}$ alloy subjected to homogenizing heat-treatment prepared in the example 3 was put into a high pressure vessel with a content volume of 140 cc, and the atmosphere in the high pressure vessel was replaced with hydrogen. Thereafter, the pressure of hydrogen was set to 8 kgf/cm$^2$ at room temperature to hermetically seal the high pressure vessel, after which the high pressure vessel was inserted in a heat-treatment furnace set to a constant temperature of 110° C. to perform hydrogen decrepitation. Then, the drop in the hydrogen pressure was terminated to confirm the end of hydrogen absorption. Thereafter, the high pressure vessel was taken out from the heat-treatment furnace, cooled to room temperature, and then opened to take out the $Sm_2Fe_{17}$ alloy. The rectangular parallelepiped of $Sm_2Fe_{17}$ alloy was found to remain the same shape as it was when put into the vessel, and not to be reduced to powder. However, mild shock easily broke the rectangular parallelepiped, which revealed that it had kept the shape with a thin film on the surface thereof. The analysis of this thin film on the surface revealed that it was α-Fe and generated at the time of the homogenizing heat-treatment.

In view of this fact, one of the rectangular parallelepipeds of $Sm_2Fe_{17}$ alloy subjected to homogenizing heat-treatment, the same lot sample, was broken to prepare 3 to 4 small ingots, conducting the same hydrogen decrepitation as described above. After confirming that the hydrogen pressure stopped dropping and hence the hydrogen absorption reached saturation, the high pressure vessel was taken out from the heat-treatment furnace and cooled to room temperature. Then, the high pressure vessel was opened to take out $Sm_2Fe_{17}$ alloy. The small alloy ingot was found to be powder, and classified with a sieve of 150 μm, showing that particles with a size of less than 150 μm was 91 wt % of recovered samples. The powder with a particle size of 150 μm or more left on the sieve was the portion corresponding to a thin film of α-Fe on the alloy surface, to which $Sm_2Fe_{17}$ was attached.

From the above description, the powder with a particle size of 150 μm or more left in the above experiments was studied, and it was found that all the powder was the portion corresponding to a thin film of α-Fe on the alloy surface, to which $Sm_2Fe_{17}$ was attached. That is, α-Fe will not absorb hydrogen, and hence the expansion of the crystal lattice due to hydrogen absorption does not occur, resulting in no break crushing. Therefore, the film of α-Fe generated on the alloy surface remained the same. The thickness of the film of α-Fe was about 100 μm to 200 μm at its thick portion in this example, but it varies depending on the amount of oxygen in an atmosphere at the time of homogenizing heat-treatment, and the time required for, or the temperature of the homogenizing heat-treatment. This means that the thickness of the film of α-Fe is considered to differ depending on the degree of oxidation thereof and the amount of Sm to be evaporated. Even if the film of α-Fe has a thickness of less than 150 μm, it has a much larger width of the order of 1 to 2 mm, and hence can be surely classified with a sieve of 150 μm to be separated from $Sm_2Fe_{17}$.

As described above, the α-Fe generated on the alloy surface by hydrogen decrepitation can be classified with a sieve of 150 μm after hydrogen decrepitation to be easily removed. This can omit troublesome working such as cutting for α-Fe on the alloy surface after homogenizing heat-treatment. Also, the obtained powder with a particle size of less than 150 μm can be made only pure $Sm_2Fe_{17}$ without containing α-Fe generated on the alloy surface, thus enhancing the magnetic characteristics after nitrogenating.

Example 5

One of the rectangular parallelepipeds each having a cross section of about 8 mm square made of $Sm_2Fe_{17}$ alloy subjected to homogenizing heat-treatment prepared in the example 3 was broken to prepare 3 to 4 small ingots. The resulting small ingots were put into a high pressure vessel with a content volume of 140 cc together with 6 balls each with a diameter of 5 mm and made of zirconia, and the atmosphere in the high pressure vessel was replaced with hydrogen. Thereafter, the pressure of hydrogen was set to 12 kgf/cm$^2$ at room temperature to hermetically seal the high pressure vessel. Then, the high pressure vessel was inserted in a heat-treatment furnace set to a constant temperature of 140° C. to perform hydrogen decrepitation. After confirming that the hydrogen pressure stopped dropping and hence that the hydrogen absorption was completed, the high pressure vessel was taken out from the heat-treatment furnace and cooled to room temperature. Then, the high pressure vessel was mildly vibrated by means of a shaker and was opened to take out $Sm_2Fe_{17}$ alloy and zirconia balls. The $Sm_2Fe_{17}$ alloy was found to be reduced to powder, and classified with a sieve of 150 μm, followed by weighing, showing that powder with a particle size of less than 150 μm was 95 wt % of the recovered powder samples. The powder with a particle size of 150 μm or more left on the sieve was the portion corresponding to a film of α-Fe generated on the alloy surface, to which $Sm_2Fe_{17}$ was attached in small amount.

As described above, hard balls which will not absorb hydrogen was put into a high pressure vessel together with small $Sm_2Fe_{17}$ alloy ingots. Then, the small alloy ingots were vibrated at the time of hydrogen absorption, which makes it possible to separate attached $Sm_2Fe_{17}$ from the film of α-Fe generated on the alloy surface, resulting in an increase in the amount of $Sm_2Fe_{17}$ to be recovered.

II. Successive treatment in a high pressure vessel

In conventional methods, in order to transfer $Sm_2Fe_{17}$ powder from a coarse crushing process to a nitrogenating process, once the powder is taken out from a coarse crusher, and put in a heat-treatment furnace or a vessel for use in the nitrogenating process over again. In this step, the $Sm_2Fe_{17}$ powder comes in contact with air, which causes oxygen or water molecules to be adsorbed to the powder surface. These oxygen and water contributed to oxidation of the powder in a nitrogenating process.

In the present invention, a coarse crushing process through a nitrogenating process were conducted in the same high pressure vessel so that oxidation can be largely controlled. Below, a detail description will now be given.

Example 6

Only the prescribed amount of electrolytic iron and Sm metal was weighed, after which electrolytic iron was placed in a crucible made of alumina to be molten in an argon gas by means of a high frequency induction heat-melting furnace, into which Sm metal was put to prepare Sm-Fe molten metal in a short time, casting an ingot by a mould made of iron. Thereafter, the obtained ingot was cooled and taken out of the melting furnace at a temperature close to room temperature. This Sm-Fe ingot was put into a heat-treatment furnace, and the atmosphere in the furnace was replaced with 99.999% argon gas. Then the temperature was raised up to 1100° C. at which the ingot was held for 12 hours to perform a homogenizing heat-treatment. The resulting alloy ingot subjected to homogenizing heat-treatment was broken into small ingots, one of which was crushed until the whole passed through a sieve of 45 μm. The crushed powder was subjected to X-ray diffraction and thermomagnetic analysis, confirming that $Sm_2Fe_{17}$ constituted most of the powder. It was also found that α-Fe was contained in small amount.

The above-described small ingot obtained by breaking the above-described alloy ingot subjected to homogenizing heat-treatment was placed in a high pressure vessel. Then, the high pressure vessel was inserted into a heat-treatment furnace while being evacuated by means of an evacuator with a diffusion pump, and the pressure within the heat-treatment furnace was set to $10^{-5}$-torr. Next, into the high pressure vessel, 99.9999% hydrogen gas was injected to a pressure of 20 kgf/cm$^2$ to hermetically seal the high pressure vessel. The pressure of hydrogen gas stopped dropping in several minutes, that is, when the temperature in the furnace reached 180° C. or thereabouts. Thereafter, the hydrogen gas expansion due to an increase in temperature resulted in an increase in the hydrogen gas pressure. When the temperature in the furnace reached 300° C. or thereabouts, the hydrogen gas was released so that the hydrogen gas pressure reached about 1 kgf/cm$^2$. The reason for this is as follows: the object herein is to reduce the alloy ingot to powder, and temperatures in the range of 300° C. to 570° C. is said to be the temperature range of desorption of hydrogen. Therefore, it is desirable that the amount of hazardous hydrogen gas is made small.

The temperature in the furnace reached 470° C., which was then maintained for 10 minutes so that the temperature in the high pressure vessel became a constant temperature of 470° C. The hydrogen gas pressure was set to 1 kgf/cm$^2$ again, after which 99.9999% nitrogen gas was injected into the high pressure vessel to make the nitrogen gas pressure 50 kgf/cm$^2$, hermetically sealing the high pressure vessel. This conditions were maintained for 3 days to $Sm_2Fe_{17}N_x$.

Next, the high pressure vessel was taken out of the heat-treatment furnace and cooled. When the high pressure vessel was cooled to temperatures in the neighborhood of room temperature, nitrogen gas was released to set the pressure in the high pressure vessel to 1 kgf/cm$^2$. Then, with being hermetically sealed, only the high pressure vessel was removed from the apparatus. Thereafter, the high pressure vessel was put into a glove box in which the atmosphere was replaced with nitrogen gas, and this high pressure vessel was opened to take out the small alloy ingot. It was found that the small alloy ingot was reduced to powder, which was then classified with a sieve of 150 μm. The classification showed that powder with a particle size of less than 150 μm was 91 wt % of the recovered powder. This powder with a particle size of less than 150 μm was subjected to X-ray diffraction, component analysis, and thermomagnetic analysis, confirming that $Sm_2Fe_{17}N_x$ (the value of x is in the neighborhood of 3) constituted most of the powder. Further, it was found that α-Fe was also contained in small amount, but the amount of α-Fe was not the order of affecting the magnetic characteristics. Also, the result of the component analysis showed that the Sm content was 23.1 wt %, less than that of the theoretical composition of $Sm_2Fe_{17}N_3$ of 23.27 wt %. The magnetic characteristics was studied by means of a vibration sample magnetometer (VSM), showing that the magnetization $\sigma_g$ was an excellent value of 153 emu/g. The $\sigma_g$ denotes the magnitude of the magnetization per 1g.

The above-mentioned $Sm_2Fe_{17}N_3$ powder with a particle size of less than 150 μm was slowly pulverized by means of a ball mill spending 50 hours to obtain powder with a particle size of 1 to 2 μm. The pulverized powder was measured for magnetic characteristics by means of a VSM, and the results show as follows: magnetization: $4\pi I_{15k}$=12.5 kG ($\sigma_{g15k}$=127.5 emu/g), residual magnetization: Br=12.0 kG, coercive force: $_iH_C$=11.0 kOe. These values showed that the obtained powder had practicability as magnetic powder for bonded magnet. The 4πI denotes the magnitude of magnetization per 1 cc.

As apparent from the above experiments, the small ingot of $Sm_2Fe_{17}$ alloy which is easily oxidized was placed in a high pressure vessel and subjected to the coarse crushing process through nitrogenating process, which makes it possible to treat the $Sm_2Fe_{17}$ powder without exposing it to air. This enables the prevention of oxidation thereof and results in magnetic powder having excellent magnetic characteristics.

Example 7

A Sm-Fe molten ingot was cut to prepare a large number of rectangular parallelepipeds each having a cross section of about 8 mm square. Then, the obtained small ingots were subjected to homogenizing heat-treatment in an atmosphere replaced with 99.999% argon gas at 1100° C. for 12 hours. One of these rectangular parallelepipeds subjected to homogenizing heat-treatment was placed in a high pressure vessel, and then subjected to the coarse crushing process through nitrogenating process in the same manner as in the example 6. After nitrogenating, the rectangular parallelepiped was taken out of the high pressure vessel in a glove box. It was found that the shape of the rectangular parallelepipied was kept. Although mild shock reduced it to powder, there existed a film on the surface portion, and this film kept the shape of rectangular parallelepiped.

On the other hand, one of the rectangular parallelepipeds subjected to homogenizing heat-treatment in the same lot was taken out, and this rectangular parallelepiped was broken into 4 to 5 small ingots to expose resulting new fracture thereof. The small ingots exposing new fracture were put into a high pressure vessel, after which the coarse crushing process through nitrogenating process were conducted in the same manner as in the example 6. After nitrogenating, the rectangular parallelepiped was taken out from the high pressure vessel in a glove box, and found to be reduced to powder in the same manner as in the example 6.

The above-described experiments showed as follows: even if homogenizing heat-treatment is conducted giving attention to oxidation, since the treatment is conducted at a temperature as high as 1100° C. and the heat-treatment time is as long as 12 hours, Sm at the surface portion of the alloy ingot vaporizes and the oxygen getting mixed therein in small amount reacts with Sm to become oxide. This results in lack of Sm at the surface portion of the alloy ingot to cause excess Fe to become α-Fe. This α-Fe covers in a skin form the surface of the alloy ingot to inhibit hydrogen decrepitation. In order to perform hydrogen decrepitation well, the film of α-Fe is broken to expose its resultant fracture. This can cause break crushing from the portion of new fracture at the time of hydrogen absorption to reduce the alloy ingot to powder.

Example 8

One of the rectangular parallelepipeds having a cross section of about 8 mm square subjected to homogenizing heat-treatment prepared in the example 7 was broken to expose resulting new fracture thereof, and then put into a high pressure vessel. Then, the coarse crushing process through nitrogenating process were conducted in the same manner as in the example 6. After nitrogenating, the high pressure vessel was opened in a glove box to take out the powdered alloy. Two different kinds of powders including the powder just as it was, and the powder with a particle size of less than 150 μm which was classified with a sieve of 150 μm and passed through the sieve were separately subjected to the subsequent fine crushing process, respectively, conducting fine crushing.

The obtained finely crushed powder was studied. It was found that the one subjected to fine crushing process just as it was without classified still contained powder of a large size, which was mixed with fine powder. Therefore, for the magnetic characteristics, the coercive force was small; and for Br of magnetization, the rectangularity in hysteresis loop was deteriorated. On the other hand, another powder obtained by subjecting only the powder with a particle size of less than 150 μm to the fine crushing process was found to be finely crushed powder, which showed the same magnetic characteristics as in example 6.

Apparent from the experiments described above, the powder obtained through the nitrogenating process was classified with a sieve of 150 μm to separate only the powder of less than 150 μm which had passed through the sieve. This makes it possible to remove the film of α-Fe at the surface portion of the alloy generated in the homogenizing heat-treatment. This can allow the subsequent fine crushing process to be well conducted, resulting in $Sm_2Fe_{17}N_x$ magnetic powder excellent in magnetic characteristics.

Example 9

The alloy ingot subjected to homogenizing heat-treatment prepared in the example 6 was broken to obtain a small ingot, which was put in a high pressure vessel, and then subjected to the coarse crushing process in the same manner as in example 6. The hydrogen gas pressure stopped dropping and started to be raised due to the gas expansion resulting from the increase in temperature, which confirmed that the hydrogen absorption was completed. When the temperature in the furnace reached 300° C. or thereabouts, the hydrogen gas was released and further evacuation was performed. The temperature in the furnace reached 470° C., which was then maintained for 10 minutes so that the temperature in the high pressure vessel became a constant temperature of 470° C. When the degree of vacuum in the high pressure vessel exceeded $10^{-4}$ torr and reached the order of $10^{-5}$torr, it is considered that the hydrogen absorbed in $Sm_2Fe_{17}$ alloy was almost desorbed. Next, 99.9999% nitrogen gas was injected into the high pressure vessel to make the nitrogen gas pressure 50 kgf/cm$^2$, hermetically sealing the high pressure vessel. This conditions were maintained for 3 days to $Sm_2Fe_{17}N_x$.

The high pressure vessel was taken out of the heat-treatment furnace, and then cooled to temperatures in the neighborhood of room temperature. Then, the nitrogen gas was released to decrease the pressure down to 1 kgf/cm$^2$. In this step, the nitrogen gas released in a room emitted irritating odor of ammonia in example 6, but was almost odorless in this example. In example 6, the hydrogen gas was not completely replaced with nitrogen gas, but the amount of hydrogen gas was decreased to a pressure of about 1 kgf/cm$^2$, to which nitrogen gas was supplied. Therefore, it is considered that a small amount of hydrogen was still absorbed in the alloy powder. Accordingly, in example 6, it is considered that some of the residual hydrogen gas reacted with nitrogen gas by the use of Fe as catalyst to become ammonia in the nitrogenating process. In this example, since hydrogen gas was completely drawn by means of an evacuator in the temperature range of 300° C. to 570° C. in which hydrogen is desorbed, it is presumed that hydrogen was not contained in the alloy. Therefore, it is considered that there occurred no reaction between hydrogen gas and nitrogen gas, resulting in no hazardous ammonia.

The nitrogen gas pressure was decreased to an easy-to-handle pressure of about 1 kgf/cm$^2$, and the high pressure vessel was put into a glove box in which the atmosphere was replaced with nitrogen gas to open the high pressure vessel and take out the small alloy ingot. The small alloy ingot was found to be reduced to powder, which was then classified with a sieve of 150 μm. The classification showed that the powder with a particle size of less than 150 μm constituted 91 wt % of the recovered powder. This powder of less than 150 μm was subjected to X-ray diffraction, component analysis, and thermomagnetic analysis, and was found not to be different from the powder in the case of the example 6. Consequently, it can be said that hydrogen gas included in the nitrogenating process has no influence on the magnetic characteristics of the powder.

Example 10

One of the rectangular parallelepipeds each having a cross section of about 8 mm square made of $Sm_2Fe_{17}$ subjected to homogenizing heat-treatment prepared in the example 7 was broken to prepare 4 to 6 small ingots. The resulting small ingots were put into a high pressure vessel with a content volume of 140 cc together with 6 zirconia balls each with a diameter of 5 mm, and the atmosphere in the high pressure vessel was replaced with hydrogen. Thereafter, the pressure of hydrogen was set to 20 kgf/cm$^2$ at room temperature to hermetically seal the high pressure vessel, after which the high pressure vessel was inserted in a heat-treatment furnace set to a constant temperature of 160° C. to perform hydrogen decrepitation. The hydrogen gas pressure was decreased by hydrogen absorption, in the course of which hydrogen gas was added so that the hydrogen gas pressure was raised up to the initial 20 kgf/cm$^2$ again. After confirming that the hydrogen pressure stopped dropping and hence that the hydrogen absorption was completed, the temperature in the heat-treatment furnace was raised at a temperature increasing rate of 10° C./min. When the temperature in the furnace reached 350° C., the hydrogen gas in the high pressure vessel was slowly exhausted down to about 1 kgf/cm$^2$. When the temperature in the furnace reached 470° C., an increase in temperature was terminated. Then, the temperature in the furnace was set to a constant temperature of 470° C. Next, nitrogen gas was injected into the high pressure vessel to make the nitrogen gas pressure 50 kgf/cm$^2$, hermetically sealing the high pressure vessel. This conditions were maintained for 3 days to nitrogenate $Sm_2Fe_{17}$ alloy.

After this nitrogenating process was completed, the high pressure vessel was taken out of the heat-treatment furnace and cooled. Then, the high pressure vessel was mildly vibrated by means of a shaker and was opened to take out the small alloy ingot and zirconia balls. The small alloy ingot was found to be reduced to powder, and the zirconia balls could be easily removed with a sieve of coarse mesh. The powder portion was classified with a sieve of 150 μm, followed by weighing, showing that powder with a particle size of less than 150 μm was 95 wt % of the recovered alloy powder samples. The powder with a particle size of 150 μm or more left on the sieve was a thin film of α-Fe generated on the alloy surface, to which little $Sm_2Fe_{17}N_x$ was attached.

Apparent from the above experiments, hard balls which will not absorb hydrogen were put into a high pressure vessel together with small $Sm_2Fe_{17}$ alloy ingots. Then, after hydrogen absorption treatment, or after nitrogenating, the high pressure vessel was vibrated, which makes it possible to separate attached $Sm_2Fe_{17}$ or $Sm_2Fe_{17}N_x$ from a thin film of α-Fe generated on the alloy surface at the time of homogenizing heat-treatment. Then, the subsequent classification can remove the film of α-Fe to increase the amount of excellent $Sm_2Fe_{17}N_x$ to be recovered.

III. Nitrogenating process

Below, experiments were conducted on nitrogenating in high temperature range in order to realize a decrease in time required for a nitrogenating process. As a result, the time required for nitrogenating with nitrogen gas could be shortened from a half day to 3 days required in conventional methods down to several hours. The present invention is based on the above-described results of the experiments, the description of which will now be given in detail below.

Example 11

The $Sm_2Fe_{17}$ alloy ingot subjected to homogenizing heat-treatment prepared in the example 6 was also used in this experiment. The homogenizing heat-treated $Sm_2Fe_{17}$ alloy ingot was broken to prepare small ingots with a size of 2 mm to 8 mm in the same manner as in example 6. Ten gram of the resulting small ingots with a size of 2 mm to 8 mm were put into a high pressure vessel. The atmosphere in the high pressure vessel was replaced with hydrogen gas, and the pressure of hydrogen gas was set to 30 kgf/cm$^2$ to hermetically seal the high pressure vessel. Thereafter, the high pressure vessel was inserted in a heat-treatment furnace maintained at a constant temperature of 90° C. to perform hydrogen decrepitation.

After hydrogen decrepitation, the hydrogen gas in the high pressure vessel was released, and then the pressure in the high pressure vessel was reduced to the order of $10^{-5}$ torr by means of an evacuator, during which the temperature of the heat-treatment furnace was raised. The temperature of the heat-treatment furnace was set to 580° C., and maintained for 10 minutes so that the temperature of the high pressure vessel became constant at this temperature, after which nitrogen gas was injected into the high pressure vessel. In conjunction with the injection of nitrogen gas, the pressure of nitrogen gas was set to 50 kgf/cm$^2$, and the high pressure vessel was maintained in this state for 4 hours. Next, the high pressure vessel was taken out of the heat-treatment furnace and cooled to room temperature. Then, the sample was taken out of the high pressure vessel, and the measurement of magnetism and X-ray diffraction were performed for the obtained sample.

It was found that 90 wt % or more of the obtained sample was reduced to powder with a particle size of less than 150 μm. This powder was measured for magnetic characteristics, showing that the magnetization $\sigma_g$ in a magnetic field of 15 kOe was 151 emu/g, which was a slightly low value but close to the literature value of $Sm_2Fe_{17}N_3$. The phase of the sample was analyzed by an X-ray diffraction, indicating that the diffraction lines were sharp, and almost all lines were the diffraction lines of $Sm_2Fe_{17}N_3$. There also arisen a main diffraction line of α-Fe, which had a size of almost negligible level. This means that $Sm_2Fe_{17}N_3$ will not be decomposed into SmN and α-Fe at a temperature of 580° C. in high pressure nitrogen gas.

The same experiments as described above were conducted except that the temperature and the time of nitrogenating were changed. The resultant relationships between the temperature and the time of nitrogenating, and magnetization $\sigma_g$ in a magnetic field of 15 kOe are shown in FIGS. 4 and 5, respectively.

Figure 4:
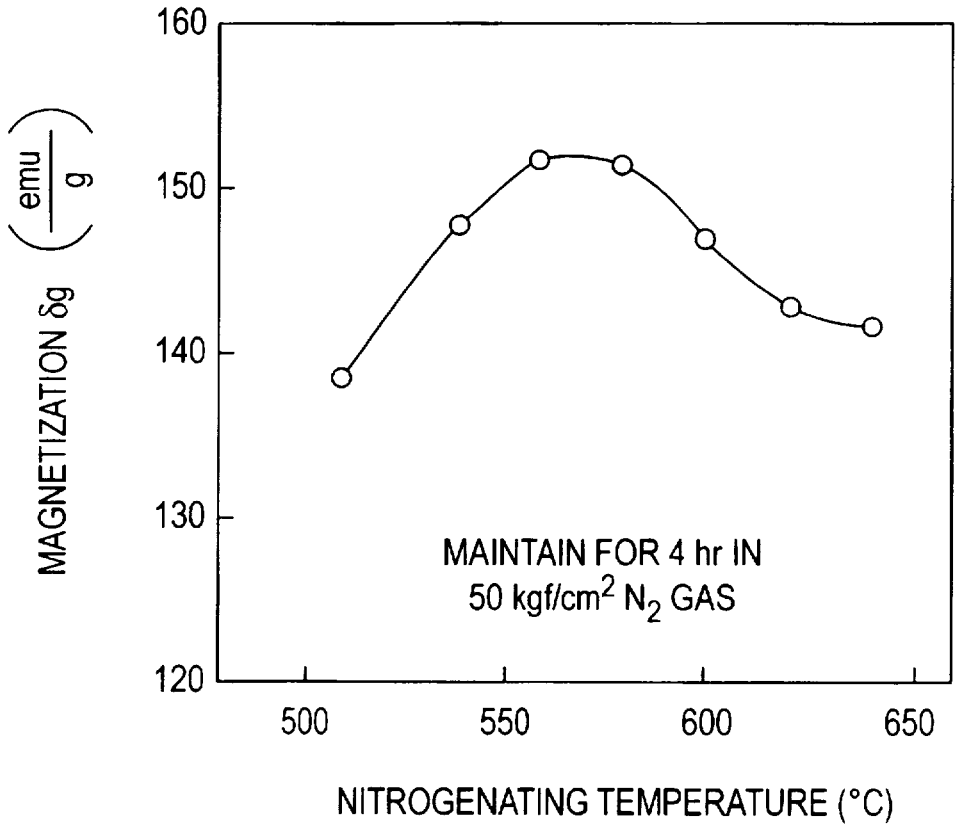
FIG. 4 is a view showing the relationship between the nitrogenating temperature and magnetization σg in example 11 of the present invention.

As shown in FIG. 4, with a heat-treatment for 4 hours, almost all $Sm_2Fe_{17}$ was nitrogenated and was not decomposed in the temperature range of 560° to 580° C. At temperatures of 600° C. or more, magnetization started to decrease, and there appeared SmN and α-Fe according to the results of X-ray diffraction. At a temperature of 640° C., it is fully decomposed into two phases, and the magnetization $\sigma_g$ was still large, which is considered to be the magnetization of α-Fe resulting from decomposition.

Figure 5:
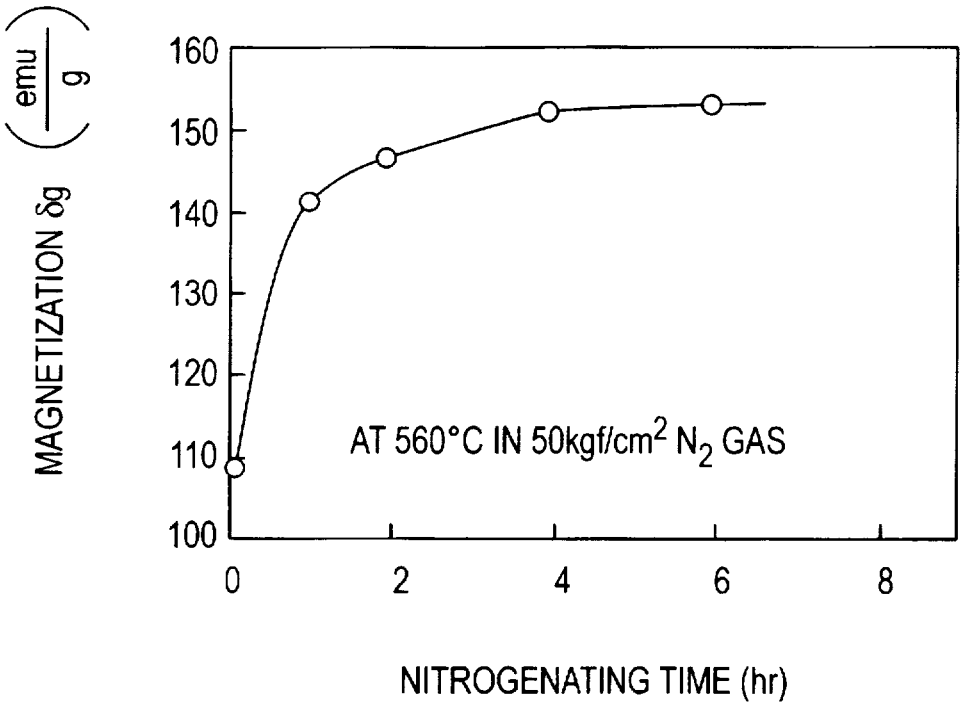
FIG. 5 is a view showing the relationship between the nitrogenating time and magnetization σg in example 11 of the present invention.

Also, as shown in FIG.5, it is found that almost all nitrogenating was completed in 4 hours in the nitrogenating process at a temperature of 560° C. These results indicated that nitrogenating in a high pressure nitrogen gas atmosphere in the temperature range of 560° to 580° C. can shorten the time required for nitrogenating down to as short as 4 hours.

Example 12

In the same manner as in example 11, some of the $Sm_2Fe_{17}$ alloy ingot subjected to homogenizing heat-treatment prepared in the example 6 were used to conduct hydrogen decrepitation treatment. Then, the high pressure vessel was evacuated, during which the temperature of the heat-treatment furnace was raised to 470° C. When the temperature reached 470° C., nitrogen gas was injected to set a pressure as low as 10 kgf/cm$^2$, which was maintained for 45 minutes. Thereafter, 15 minutes was spent to increase the temperature up to 600° C., and from the time when the temperature reached 560° C. or thereabouts, the pressure of nitrogen gas was increased to 50 kgf/cm$^2$. The high pressure vessel was maintained for 2 hours at a temperature of 600° C., and then taken out of the heat-treatment furnace to be cooled to room temperature.

The powder which was taken out of the high pressure vessel and passed through a sieve of 150 μm was measured for magnetic characteristics, showing that the magnetization $\sigma_g$ was 151 emu/g. Then, the results of X-ray diffraction indicated that almost all the powder became $Sm_2Fe_{17}N_x$ (wherein the value of x is in the neighborhood of 3), and also that the size of the diffraction line of α-Fe was on a negligible level. Accordingly, it can be said that there hardly occurred decomposition.

An experiment was conducted on the nitrogenating at a temperature of 600° C. by changing the time required for nitrogenating. As a result, after an elapse of 1 hour, nitrogenating was not completed yet, and the magnetization was a slightly low value of 148 emu/g. With nitrogenating for 4 hours, the magnetization started to drop, and became a slightly low value. However, the nitrogenating time in the range of 1 to 4 hours is sufficiently practicable.

As in the case of example 11, at a temperature of 600° C., the sample was allowed to come in direct contact with nitrogen gas to cause nitrogenating reaction. The nitrogenating reaction is an exothermic reaction, which increases the temperature up to the decomposition temperature, resulting in a decrease in magnetization. To this, it can be said that the following step is effective for shortening the time required for nitrogenating. As in this example, first, in the low temperature range, nitrogenating reaction is slowly effected, and only the easy-to-react surface portion of particle is allowed to react, and then for the remaining portion, especially the interior of particle, diffusion and reaction are accelerated in the high temperature range.

Various combinations of low pressure gas nitrogenating in the low temperature range and high pressure gas nitrogenating in the high temperature range were studied. This revealed that the time required for the nitrogenating process could be shortened. In this case, the low temperature range refers to temperatures in the range of 400° to 500° C., and the low pressure gas nitrogenating denotes the nitrogenating in nitrogen gas at pressures of 30 kgf/cm$^2$ or less and to atmospheric pressure. On the other hand, the high temperature range refers to temperatures in the range of 560° to 620° C., and the high pressure gas nitrogenating denotes the nitrogenating in nitrogen gas at pressures of 40 kgf/cm$^2$ or more, preferably 50 kgf/cm$^2$ or more, and to about 80 kgf/cm$^2$ because of the pressure resistance of the high pressure vessel.

IV. High pressure heat-treatment apparatus

Below, a description will now be given to a simple high pressure heat-treatment apparatus suitable for hydrogen decrepitation and high pressure nitrogenating by the use of a high pressure vessel.

The maximum temperature in actual use in the coarse crushing process and nitrogenating process in accordance with the present invention is 620° C., but may exceed the above-described temperature in some cases. In view of this fact, as a high pressure apparatus usable for long time, in the temperature range up to 650° C., and withstanding pressures up to 80 kgf/cm$^2$, which is considered to be sufficient although the pressure of gas to be used is 50 kgf/cm$^2$ or more, at present an apparatus referred to as autoclave has been known. This apparatus, perhaps for safety reasons, utilizes stainless steel plates having a considerable wall thickness. In this autoclave, that of an external heating type employs a method whereby a tube-like vessel having an external diameter larger than internal diameter, i.e., a considerable wall thickness, and closed at one end is put into a large electric furnace to conduct heating. The heating and cooling of the vessel requires time. On the other hand, the one including a heater within the vessel (that of an internal heating type) increases in internal diameter by the size of the heater, resulting in an increased area of the portion of the lid for getting a sample in and out. This requires a large number of bolts in order to withstand the pressure applied to the lid. Therefore, the autoclave of an internal heating type results in a large scale apparatus, and hence even only the handling of the lid corresponds to the transfer of heavy goods, requiring very cumbersome labor.

Then, various studies have been conducted, leading up to realization of a high pressure heat-treatment apparatus capable of treating a large number of samples simply.

Example 13

Figure 6:
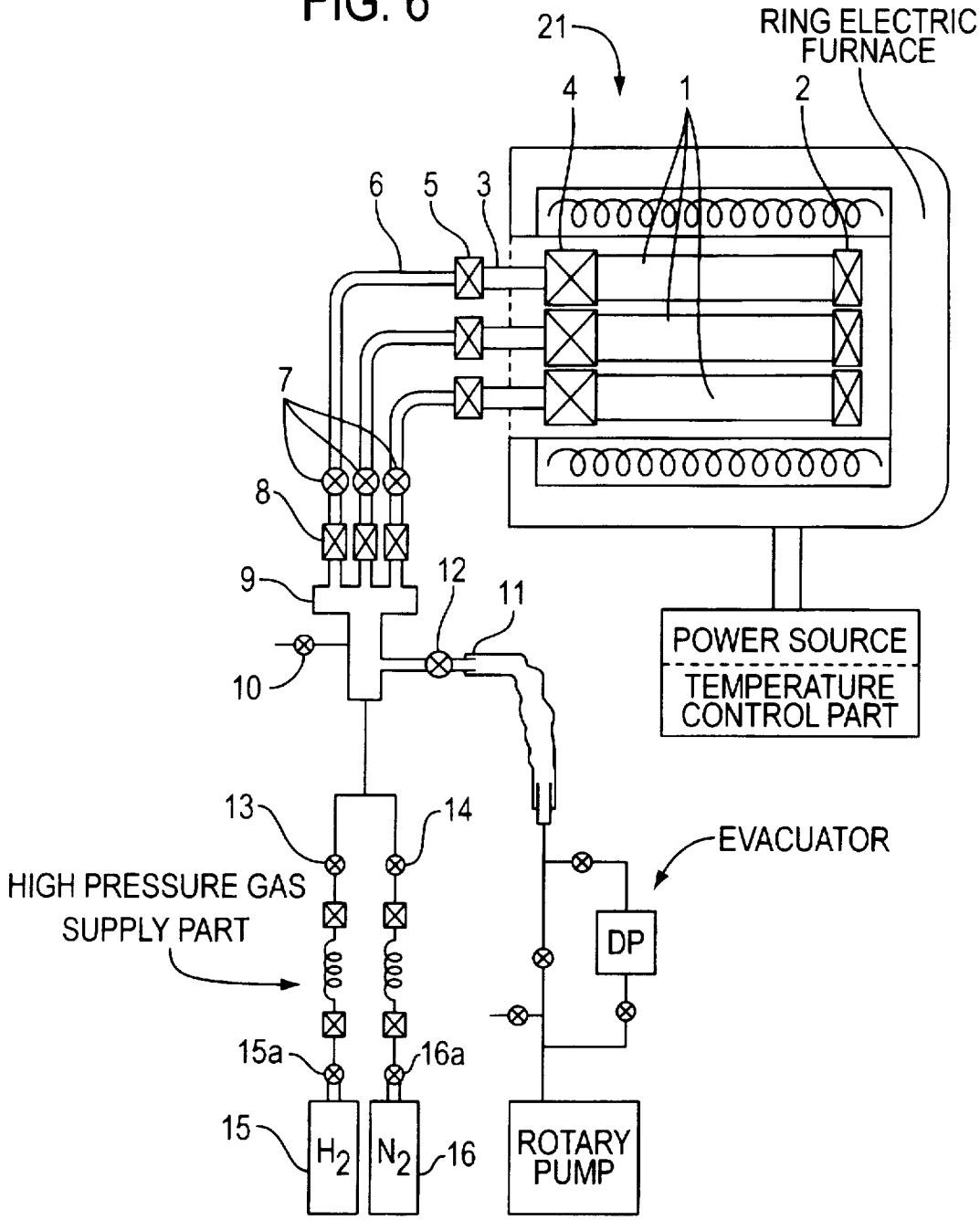
FIG. 6 is a view describing the construction of a high pressure heat-treatment apparatus in accordance with the present invention.

A high pressure heat-treatment apparatus in accordance with this example includes, as shown in FIG.6, a ring electric furnace of a horizontal type, power source for this electric furnace (including a temperature control part), a high pressure vessel (including a high pressure piping part), an evacuator, and a high pressure gas supply part. The high pressure heat-treatment apparatus in accordance with this example is characterized by the part of the high pressure vessel (including a high pressure piping part). The other mechanisms are a combination of commonly used devices.

Below, a high pressure vessel (including a high pressure piping part) 21 will now be described.

The high pressure vessel 21 is characterized by the construction as follows. It is provided with three raw material accommodating parts 1 composed of large pipes for high pressure piping made of stainless steel and for accommodating raw material ingots or particles. Each raw material accommodating part 1 is horizontally maintained, and there exists the space which will not be filled with raw material ingots or particles in the upper portion within each raw material accommodating part 1.

The high pressure vessel 21 in this example is a triple type in which three raw material accommodating parts 1 are arranged in parallel with each other. Each one end of the three raw material accommodating parts 1 composed of pipes for high pressure piping, for example, of 25.4 mm in external diameter, 21.2 mm in internal diameter, and 1000 mm in length is closed with a Swagelok piping blocking member 2. Each of the other ends is joined to the corresponding one of the three first pipes for high pressure piping 3, for example, of 12.7 mm in external diameter and made of stainless steel through a Swagelok piping joint member 4, respectively. Each of the other ends of the first pipes for high pressure piping 3 is joined through a pressure-resistant and removable first removable joint member 5 to each end of three second pipes for high pressure piping 6 of, for example, 6.35 mm in external diameter. Each of the second pipes for high pressure piping 6 is gently bend to a right angle at the midway portion thereof, and has a first passage closing valve 7. Each of the other ends thereof is joined through a Swagelok second removable joint member 8 which is removable at a single motion to a high pressure piping part 9. To the high pressure piping part 9 joined is an exhaust valve 10, and a connecting part 11 between the high pressure piping part 9 and an evacuator on the high pressure piping part 9 side is provided with a second passage closing valve 12. The coupling part between the high pressure piping part 9 and the high pressure cylinders of hydrogen and nitrogen of the high pressure supply part on the high pressure piping part 9 side is provided with third and fourth passage closing valves 13 and 14.

In this example, the raw material accommodating parts 1 for accommodating raw material ingots or particles are provided in a triple form, and the triple raw material accommodating parts 1 are tied in parallel with each other to be inserted in the horizontal type of ring electric furnace so that each raw material accommodating part 1 is kept in uniform temperature distribution. Each pipe for high pressure piping made of stainless steel and each joint member can sufficiently withstand a pressure of 80 kgf/cm$^2$ at temperatures up to 650° C.

Below, the method for using the above-described high pressure heat-treatment apparatus will now be described.

One of the raw material accommodating parts 1 and the second pipes for high pressure piping 6 are removed from the high pressure piping part 9 at the second removable joint member 8. Then, this raw material accommodating part 1 is removed from the second pipe for high pressure piping 6 at the first removable joint member 5. Thereafter, into the raw material accommodating part 1, put is $Sm_2Fe_{17}$ alloy powder crushed to a size of 8 mm or less after homogenizing heat-treatment. One raw material accommodating part 1 can accommodate a maximum amount of 780 g of particles. That is, 7.8 g of $Sm_2Fe_{17}$ alloy particles are accommodated per 1 cm in length of the raw material accommodating part 1. Since the apparent density of the alloy particles is about 4.0 g/cc, the alloy particles accounts for 1.95 cm$^2$ of the cross sectional area of the raw material accommodating part 1, while the cross sectional area of the raw material accommodating part 1 is 3.53 cm$^2$. Accordingly, the alloy particles accounts for 55% of the cross sectional area of the raw material accommodating part 1, and the remaining area of 45% of the raw accommodating part 1 is space. This space is important, in which hydrogen gas moves, and permeates through the whole alloy particles, while hydrogen is desorbed from the alloy particles for a short time. In contrast to this, when the thickness of the alloy particles reaches 3 cm in such a state that the raw material accommodating part 1 is filled with the alloy particles, the alloy particles undergo hydrogen decrepitation to be reduced to fine particles of less than 150 μm. Therefore, in the step of desorbing hydrogen, when hydrogen gas desorbed from the alloy particles distant from the above-described space is exhausted, fine alloy particles are finally caught in hydrogen gas to be drawn into the evacuator.

Next, $Sm_2Fe_{17}$ alloy particles are also accommodated in the other two raw material accommodating parts 1 in the same manner as described above. Then, each of the three raw material accommodating parts 1 is joined through the corresponding first removable joint member 5 to the corresponding second pipe for high pressure piping 6, respectively. Thereafter, each second pipe for high pressure piping 6 is joined through the corresponding second removable joint member 8 to the high pressure piping part 9, respectively. Then, each raw material accommodating part 1 is given a vibration or shaken vertically with being maintained in substantially horizontal posture, so that the alloy particles therein becomes uniform and space is formed at the upper portion within each raw material accommodating part 1. In this step, the second pipes for high pressure piping 6 are rotatable at the second removable piping members 8 with respect to the high pressure piping part 9, and bend to a right angle, thus enabling vertical shaking of the raw material accommodating parts 1.

Then, the evacuator is allowed to operate, and the first passage closing valve 7 is closed, while the second passage closing valve 12 is opened to evacuate the inside of the high pressure piping part 9. Then, the third passage closing valve 13 and the fourth passage closing valve 14 are opened to evacuate the inside of the piping in the high pressure gas supply part. Thereafter, the first passage closing valve 7 is opened to exhaust the inside of each raw material accommodating part 1 in which the above-described space is formed. The degree of vacuum within the raw material accommodating parts is enhanced to $10^{-4}$torr or more to almost completely exhaust oxygen in the raw material accommodating parts 1. Then, the second and fourth passage closing valves 12 and 14 are closed, while the pressure adjustment valve 15*a* of the hydrogen cylinder 15 is opened to supply hydrogen gas into the raw material accommodating part 1. Next, the inside of the raw material accommodating part 1 is set to about 15 kgf/cm$^2$, and heated by means of the horizontal type of ring electric furnace which has already been increased in temperature to 90° C.

Hydrogen absorption starts at a temperature of about 70° C., and $Sm_2Fe_{17}$ alloy particles are contained in a maximum amount in the raw material accommodating part 1. Therefore, hydrogen is increasingly absorbed by the alloy particles, and hence the pressure adjustment valve 15*a* of the hydrogen cylinder 15 is adjusted so as to produce a pressure of about 15 kgf/cm$^2$ and held open. The raw material accommodating part 1 is maintained at a temperature of 90° C. for about 1 hour to complete hydrogen decrepitation. Then, the pressure adjustment valve 15*a* of the hydrogen cylinder 15 and the third passage closing valve 13 are closed, while the exhaust valve 10 is opened to exhaust extra hydrogen gas. When the pressure within the raw material accommodating part 1 approaches atmospheric pressure, the exhaust valve 10 is closed to open the second passage closing valve 12 gradually, exhausting hydrogen gas. With exhausting hydrogen gas, the ring electric furnace is increased in temperature toward 470° C.

Then, the degree of vacuum within the raw material accommodating part 1 is increased to $10^{-4}$torr or less to completely draw hydrogen gas, and when the temperature of the raw material accommodating part 1 reaches 470° C., the pressure adjustment valve 16*a* of the nitrogen cylinder 16 and the fourth passage closing valve 14 are opened to inject nitrogen gas into the raw material accomodating part 1. The inside of the raw material accomodating part 1 is set to a pressure of about 10 to 20 kgf/cm$^2$, and the supply of nitrogen gas from the nitrogen cylinder 16 is continued to supply the required amount of nitrogen gas. This state is maintained for 3 days to conduct nitrogenating. Also, when it is required that nitrogenating is completed for a short time, the temperature is maintained at 470° C. for 40 minutes, and then the temperature of the ring electric furnace is raised to the temperature range of 560° to 620° C., while the pressure of nitrogen gas is made 50 kgf/cm$^2$ or more in order to let the heat of reaction escape. Thus, the nitrogenating reaction and diffusion are accelerated, fully completing nitrogenating for 2 to 4 hours.

When nitrogenating is completed, the pressure adjustment valve 16a of the nitrogen cylinder 16 and the fourth passage closing valve 14 are closed to draw out the raw material accommodating part 1 from the ring electric furnace, and cool it. When the raw material accommodating part 1 is cooled to temperatures in the neighborhood of room temperature, the exhaust valve 10 is opened to let nitrogen gas escape, setting the inside of the raw material accommodating part 1 to atmospheric pressure. Then, the first passage closing valve 7 is closed, and the raw material accommodating part 1 and second pipe for high pressure piping 6 are separated from the high pressure piping part 9 at the second removable joint member 8. The same is conducted with the other two raw material accommodating parts 1.

Then, the high pressure vessel 21 is put into a glove box in which the atmosphere is replaced with nitrogen to recover nitrogenated powder.

In the above-described example, since the length of the raw material accommodating part 1 is 1000 mm, the amount of powder to be treated at one step is 2.3 kg. But, an increase in length of the raw material accommodating part 1 or in number of the high pressure vessel 21 can increase the amount of powder to be treated at one step. Also, the size of the raw material accommodating part 1 is more enlarged so that raw materials are accommodated in such a degree that the raw material accommodating part 1 is half-full. This prevents the powder from being whirled up when gas is exhausted from the raw material accommodating part 1. When the diameter of the pipes for high pressure piping constituting the raw material accommodating part 1 is made the order of 2 inch, it is easy to treat raw materials of the order of 10 kg in one step.

Example 14

The high pressure heat-treatment apparatus of this example is basically the same as that of the example 13, except that a fluidized bed furnace is used in place of a ring electric furnace, and that as a high pressure vessel the inverted T-shaped one containing a T-shaped joint and two raw material accommodating parts (pipes for high pressure piping of an external diameter of 1 inch) for accommodating raw material ingots or particles, the two raw material accommodating parts being joined on both sides of the T-shaped joint, is used. Each raw material accommodating part was charged with raw material in such an amount as to leave the upper space thereof, and then put in a horizontal posture. Thereafter, the inside of the raw material accommodating part was replaced with hydrogen gas to set the pressure of hydrogen gas to 15 kgf/cm$^2$, immersing the raw material accommodating part in the fluidized bed furnace at a temperature of 90° C. Since the alumina particles at a temperature of 90° C. has come in contact with the surface of the raw material accommodating part as liquid, the temperature increasing rate was extremely high. The raw material accommodating part was increased in temperature up to 90° C., and then maintained at a temperature of 90° C. for 1 hour or more, thus completing hydrogen decrepitation.

Next, high pressure hydrogen gas was allowed to escape outside to exhaust hydrogen gas by means of an evacuator. When 2 hours and 10 minutes had elapsed after immersion, the raw material accommodating part was taken up, and immersed in the fluidized bed furnace at 470° C. When the degree of vacuum reached the order of $10^{-4}$torr, nitrogen gas was injected to set the pressure to 20 kgf/cm$^2$, which was maintained for 45 minutes or more.

When 2 hours and 10 minutes had elapsed after immersion, the raw material accommodating part was taken up, and immersed in the fluidized bed furnace at 580° C. The pressure of nitrogen gas was raised up to 50 kgf/cm$^2$, which was maintained for about 2 hours, thus completing nitrogenating. When 2 hours and 10 minutes had elapsed after immersion, the raw material accommodating part was taken up, and then air-cooled to room temperature. Thus, immersion into the fluidized bed furnace of higher temperature is successively repeated at a 2 hours and 10 minute cycle, making it possible to successively conduct treatment. The raw material accommodating part was cooled, separated from the high pressure piping part, and then put into a glove box containing nitrogen gas atmosphere to recover nitrogenated powder. The obtained powder had a magnetization of 150 emu/g or more.

As described above, a series of processes for nitrogenating at high pressure after hydrogen decrepitation are performed by the use of a plurality of fluidized bed furnaces, although each high pressure vessel undergoes batch type treatment, making it possible to immerse a plurality of high pressure vessels successively, enabling the treatment of a large quantity of powder.

V. Homogenizing heat-treatment

At the surface area of the alloy ingot subjected to homogenizing heat-treatment used so far, generated is a thin film of α-Fe, which will not undergo hydrogen decrepitation, and hence remains as particles of 150 μm or more. This α-Fe film can be removed with a sieve after nitrogenating, but is an inferior portion as magnetic powder and hence the generation thereof must be controlled as little as possible. The reason for the generation of the thin film of α-Fe at the surface portion of the alloy ingot is as follows: high vapor pressure of Sm causes Sm to escape in the form of vapor, resulting in a decrease in the amount of Sm at the surface portion of the alloy ingot. This generates α-Fe in an amount corresponding to the amount of Sm decreased.

Below, methods whereby α-Fe is not formed on the surface portion of the alloy ingot have been studied, and the results are given as examples.

Example 15

In order to make Sm-Fe alloy ingot a homogeneous phase state in which $Sm_2Fe_{17}$ phase is the main phase, it is necessary to heat-treat the alloy ingot at temperatures exceeding 1010° C. and of less than 1280° C. for a time in the range of several hours to several tens hours. Therefore, an apparatus was prepared which is capable of setting the temperature to the order of 1200° C. and applying gas pressure of several atmospheric pressures in an inert atmosphere. This high pressure and high temperature heat-treatment apparatus is of the type in which a heater is provided in a pressureresistant high pressure vessel which is being water-cooled. An alloy ingot in a bowl made of alumina was placed in the space portion within the heater, and the high pressure vessel was hermetically sealed to be evacuated, enhancing the degree of vacuum to the order of $10^{-5}$torr. The temperature was started to be increased, and maintained at a temperature of about 200° C., and the degree of vacuum is set to the order of $10^{-5}$torr to conduct baking. Then, argon gas was introduced into the high pressure vessel, the pressure of which was raised up to 20 kgf/cm$^2$, and the temperature was increased to 1200° C. The vapor pressure of Sm is 0.016 kgf/cm$^2$ at a temperature of 1200° C., and hence the vaporization of Sm is inhibited by the pressure of argon gas. The alloy ingot was maintained at a temperature of 1200° C. for 6 hours to be homogenized. Then, the temperature was decreased, in the course of which argon gas was exhausted and replaced with hydrogen gas in the temperature range of 350° C. to 70° C. With setting the pressure of hydrogen gas to 20 kgf/cm$^2$, hydrogen absorption was effected. When the hydrogen gas pressure stopped dropping, it was concluded that hydrogen absorption reached saturation and completed. This time, the temperature was then increased, and at a temperature of 400° C. or more, hydrogen gas was exhausted and completely extracted to the degree of vacuum of the order of $10^{-4}$torr.

Next, the temperature was set at 470° C. to inject nitrogen gas, which was maintained for about 1 hour. Then, the temperature was further raised to 560° C., and the nitrogen gas pressure was set at 50 kgf/cm$^2$ or more to accelerate nitrogenating. When the alloy ingot was maintained for about 4 hours to complete nitrogenating, the temperature was decreased and cooled to room temperature. The high pressure vessel was opened to take out the powdered alloy, which was then classified with a sieve of 150 μm. Most of the alloy powder passed through the mesh of the sieve, which indicates that an α-Fe film is not formed at the surface area of the alloy ingot. The powder had a magnetization $\sigma_g$ of 152 emu/g or more, and hence had good magnetic characteristics.

In the step of this example, argon gas was used, but helium which is inert gas may be used. Also, the pressure is required to be about two figures order higher than the most high vapor pressure of the elements contained in the components of R-T alloy.

According to this method, it is not required that an alloy ingot is crushed to expose new fracture with no α-Fe film, and the alloy ingot can be used as it stands, resulting in the reduced number of steps. Also, in this method, the processes from homogenizing heat-treatment through nitrogenating can be performed in the same high pressure vessel, making it possible to more prevent oxidation, resulting in excellent powder with high yield.

VI. Fine crushing process

According to the above-described hydrogen decrepitation process and high pressure nitrogenating process, an alloy ingot can be treated in the same high pressure vessel without coming in contact with air, which causes extremely little oxidation, resulting in pure and excellent nitrogenated powder. In order to make this powder magnetic powder, it is required to reduced the powder to fine powder with a particle size of 1 to 3 μm. Below, a fine crushing process will now be described.

Example 16

The nitrogenated powder of $Sm_2Fe_{17}N_X$ (X=2.8 to 3.1) obtained by the same process as that of the example 13 was put into a vibrating ball mill vessel made of metal together with balls made of stainless steel, and then the atmosphere was replaced with nitrogen. Then, the vibrating ball mill vessel was immersed in liquid nitrogen. When the whole vibrating ball mill vessel was cooled down to the liquid nitrogen temperature, it was placed in the vibrating ball mill, which was then operated to crush the nitrogenated powder. After an elapse of 5 minutes, the operation was once stopped, and the temperature was raised to room temperature to recover a part of the crushed powder in a glove box including nitrogen atmosphere. Also, the temperature was cooled down to the liquid nitrogen temperature over again, followed by crushing with the vibrating ball mill. After an elapse of 5 minutes, crushing was stopped again to take samples. In such a manner, samples were taken every 5 minutes, thus repeating the crushing process until the cumulative length of crushing time reached 30 minutes.

The recovered samples were measured for magnetism to study the increase in the coercive force. As a result, the coercive force after an elapse of 5, 10, and 15 minutes was 5.0 kOe, 10 kOe, and 13 kOe, respectively. The time required for the samples to reach the same coercive force as that in conventional processes where crushing was conducted at room temperature was reduced to almost half in the case of the conventional processes.

Apparent from the above-described results, the cooling of the nitrogenated powder down to the liquid nitrogen temperature causes embrittlement of the quality thereof, and hence making the nitrogenated powder to be easily broken, enabling the shortening of the crushing time.

Example 17

The particles of 45 μm or less of the nitrogenated powder of $Sm_2Fe_{17}N_X$ (X=2.8 to 3.1) obtained by the same process as that of the example 13 was put into cyclohexane, and mixed. Then, the mixture was subjected to fine crushing by means of a high pressure solution impact pulverizer. This device conducts fine crushing as follows: particles are mixed and suspended in a solvent or suspension. The mixed suspension was applied with high pressure (100 to 3000 kgf/cm$^2$) to cause high pressure and high velocity impacts with each other through a passage diverging from a midway point. This device is characterized in that fine crushing is conducted for an extremely short time, and that the solvent or suspension can be recycled, resulting in low running cost. Although when one circulation results in insufficient fine grinding, the circulation can be repeated as many times as desired, the time required for one circulation is short, and hence the overall processing time is not much elongated.

In this example, samples were circulated 20 times with application of the maximum pressure of 3000 kgf/cm$^2$ of the current device to conduct fine crushing. After fine crushing, cyclohexane was vaporized to recover fine particles, which were then measured for magnetism. The results showed that the coercive force was 9.2 kOe.

The powder used in this example had a particle size of 45 μm or less, which was determined based on the restriction by the used device, but larger particles can be handled by enlarging the diameter of the passage.

Example 18

The same device as that in the example 17 was used, and the nitrogenated powder in the same lot was also used. As solvent, methyl ethyl ketone in which 30 wt % solid epoxy resin was dissolved was used. The samples were circulated 30 times at a pressure of 1300 kgf/cm$^2$ to be finely crushed. The recovered and dried fine powder was set with epoxy resin, and hence ground by a mortar. The result of the measurement of the magnetism indicated that the coercive force was 10.5 kOe, and the samples were completely reduced to fine powder. This fine powder was added with a latent curing agent in a fine powdered form, and fully mixed, after which the mixture was subjected to compression-molding in magnetic field and curing heat-treatment, resulting in bonded magnet.

According to this method, the further addition of resin or the other materials required for making bonded magnet such as curing agent or flame retarder into the suspension can attach binder such as epoxy resin onto the surface of the nitrogenated powder. This makes it possible to incorporate a part of the process for making bonded magnet into the fine crushing process, simplifying the process.

In the above-described examples, a detail description was given to the present invention concentrating on the $Sm_2Fe_{17}$ system and nitrogenate thereof, i.e., the $Sm_2Fe_{17}N_x$ system, but it is not construed that the present invention is limited to these examples. The following systems may be used: the system obtained by replacing a part of Sm with the other rare earth elements; the system obtained by replacing a part of Fe with the other transition elements; or the system obtained by adding trace amount of the other additional elements to these systems for improving the magnetic characteristics, the resistance to oxidation and temperature characteristics thereof. In the present invention, these are generically referred to as alloy powder of the $R_2T_{17}$ system or the magnetic materials of the $R_2T_{17}N_x$ system.

Also, as for the composition range, the present invention is effective within the same composition range as that already disclosed. The composition within such a composition range is $Sm_2Fe_{17}N_x$, wherein R is in the range of 12.5 to 37.9 wt %, and N is in the range of 0.1 to 7.0 wt %. However, the range of the composition for making practicable magnetic materials having excellent magnetic characteristics is limited. The range covers, as shown in each example, the one centering on the $Sm_2Fe_{17}$ system and nitrogenate thereof, i.e., the $Sm_2Fe_{17}N_x$. As Sm content, examples of the $Sm_2Fe_{17}$ system include the neighborhood of 2:17 composition, wherein R is in the range of 22.8 to 25.3 wt %. Examples of the $Sm_2Fe_{17}N_x$ system include the neighborhood of 2:17:3 composition, wherein R is in the range of 22.1 to 24.5 wt %. Also, the N content is in the range centering on X=3, and in the range of 2.1 to 3.8 wt %. Deviation from this range results in slightly low value as the magnetic characteristics.

We claim:

1. A method for producing a $R_2T_{17}$ alloy powder wherein R is Sm or a substance obtained by replacing a part of Sm with one or more rare earth elements, and T is Fe or a substance obtained by replacing by a part of Fe with one or more transition elements, the method comprising:

(a) heat-treating an ingot containing R and T to form a $R_2T_{17}$ alloy ingot having a $Th_2Zn_{17}$ crystal lattice structure;

(b) hydrogen decrepitating said $R_2T_{17}$ alloy ingot in a vessel containing hydrogen gas at a temperature of 70° C. to 300° C. and at a pressure of 5 kgf/cm$^2$ to 50 kgf/cm$^2$ whereby said $R_2T_{17}$ alloy ingot is caused to absorb said hydrogen gas and is changed into a $R_2T_{17}$ alloy powder having a particle size of less than 150 μm; and (c) desorbing said hydrogen gas from said $R_2T_{17}$ alloy powder.

2. The method for producing a $R_2T_{17}$ alloy powder of claim 1, wherein said step (b) comprises a step of causing said $R_2T_{17}$ alloy ingot to absorb hydrogen gas only one time.

3. The method for producing a $R_2T_{17}$ alloy powder of claim 1, wherein said step (b) further comprises a step of breaking said $R_2T_{17}$ alloy ingot prior to causing said $R_2T_{17}$ alloy ingot to absorb hydrogen gas.

4. The method for producing a $R_2T_{17}$ alloy powder of claim 1, wherein said step (b) further comprises a step of classifying said $R_2T_{17}$ alloy powder to obtain particle sizes of less than 150 μm.

5. The method for producing a $R_2T_{17}$ alloy powder of claim 1, wherein said step (b) further comprises the steps of placing said $R_2T_{17}$ alloy ingot into said vessel together with hard balls which do not absorb hydrogen; and vibrating said vessel to crush said $R_2T_{17}$ alloy ingot.

* * * * *

UNITED STATES PATENT AND TRADEMARK OFFICE

CERTIFICATE OF CORRECTION

PATENT NO. : 5,776,263

DATED : July 7, 1998

INVENTOR(S) : Kojima et al.

It is certified that error appears in the above-identified patent and that said Letters Patent is hereby corrected as shown below:

On the title page, item [54] and column 1, line 4

In the title, line 4 delete "of the", second occurrence.

Signed and Sealed this

Twelfth Day of January, 1999

*Attest:*

*Attesting Officer*

*Acting Commissioner of Patents and Trademarks*